US009440759B2

(12) United States Patent
Reed

(10) Patent No.: US 9,440,759 B2
(45) Date of Patent: Sep. 13, 2016

(54) CONTAINER LABELING SYSTEMS AND METHODS OF USE

(71) Applicant: Lorin Reed, Kingsburg, CA (US)

(72) Inventor: Lorin Reed, Kingsburg, CA (US)

( * ) Notice: Subject to any disclaimer, the term of this patent is extended or adjusted under 35 U.S.C. 154(b) by 0 days.

(21) Appl. No.: 14/177,204

(22) Filed: Feb. 10, 2014

(65) Prior Publication Data

US 2015/0225104 A1 Aug. 13, 2015

(51) Int. Cl.

| | |
|---|---|
| ***B65C 1/02*** | (2006.01) |
| ***B65C 9/02*** | (2006.01) |
| ***B65C 9/40*** | (2006.01) |

(Continued)

(52) U.S. Cl.

CPC ..... *B65C 1/028* (2013.01); *B41J 3/4073* (2013.01); *B65B 57/10* (2013.01); *B65B 61/26* (2013.01); *B65C 1/021* (2013.01); *B65C 9/02* (2013.01); *B65C 9/40* (2013.01); *B65C 9/46* (2013.01);

(Continued)

(58) Field of Classification Search

CPC ..... B41J 3/4073; B41J 2/442; B65C 1/02; B65C 1/021; B65C 9/02; B65C 1/1884; B65C 9/36; B65C 9/40; B65C 9/46; B65C 1/028; B64C 1/028; B65B 57/10; B65B 61/26; Y10T 156/1744; Y10T 156/10

USPC ..... 347/110, 224, 225, 229, 234, 248, 262, 347/264; 156/60, 66, 277, 362, 384, 386, 156/387, 556, 563

See application file for complete search history.

(56) References Cited

U.S. PATENT DOCUMENTS 4,102,728 A * 7/1978 Smith ..... B65C 3/065 156/362
4,751,805 A * 6/1988 Walter ..... B29C 51/18 53/168

(Continued)

FOREIGN PATENT DOCUMENTS

DE 10228243 B4 8/2008
EP 1002730 B1 3/2004

(Continued)

OTHER PUBLICATIONS

Austermeier, G., Cross web labeling method and apparatus, English Abstract of German Patent Publication DE1022824, Aug. 21, 2008, European Patent Organization, http://www.epo.org/searching/free/espacenet.html.

(Continued)

*Primary Examiner* — Kristal Feggins
(74) *Attorney, Agent, or Firm* — Mark D. Miller; William K. Nelson

(57) ABSTRACT

The invention relates to labeling and/or printing devices, methods and systems for applying coding and/or labeling to containers that are stacked or otherwise organized in a group (e.g., containers stacked on a pallet). In embodiments of the invention, labeling and/or printing devices are mounted on carriages that are capable of moving in a vertical direction to apply labels as they move. Horizontal movement is imparted either by moving such carriages in a horizontal direction adjacent to the containers, or by moving the containers themselves (or the pallet holding them) in a horizontal direction adjacent to such carriages. Multiple carriages with labeling devices may be provided to provide simultaneous labeling to more than one side of a group of stacked containers. Embodiments of the invention are capable of providing labeling of containers that are uniformly or non-uniformly grouped or stacked.

48 Claims, 18 Drawing Sheets

(51) Int. Cl.

| | |
|---|---|
| ***B65C 9/46*** | (2006.01) |
| ***B41J 3/407*** | (2006.01) |
| ***B65B 61/26*** | (2006.01) |
| ***B65B 57/10*** | (2006.01) |

(52) U.S. Cl.
CPC ..... *Y10T 156/10* (2015.01); *Y10T 156/1744* (2015.01)

(56) References Cited

U.S. PATENT DOCUMENTS

| | | | | |
|---|---|---|---|---|
| 5,250,138 | A | 10/1993 | Szewczyk et al. | |
| 5,259,648 | A | 11/1993 | Gerber | |
| 5,674,335 | A | 10/1997 | Aman et al. | |
| 6,080,250 | A | 6/2000 | Urban et al. | |
| 6,529,799 | B1 | 3/2003 | Paulk, Jr. et al. | |
| 6,571,849 | B2 | 6/2003 | Erickson et al. | |
| 6,655,436 | B1 | 12/2003 | Venditti et al. | |
| 6,793,758 | B2 | 9/2004 | Erickson et al. | |
| 7,185,689 | B2 | 3/2007 | Jenkins et al. | |
| 7,354,498 | B2 * | 4/2008 | Jenkins | B65C 1/021 156/277 |
| 8,365,788 | B2 | 2/2013 | Le | |
| 2002/0092593 | A1 | 7/2002 | Erickson et al. | |
| 2003/0209316 | A1 | 11/2003 | Erickson et al. | |
| 2004/0094253 | A1 | 5/2004 | Jenkins et al. | |
| 2007/0158029 | A1 | 7/2007 | Jenkins et al. | |
| 2010/0200159 | A1 | 8/2010 | Le | |

FOREIGN PATENT DOCUMENTS

| | | | | |
|---|---|---|---|---|
| FR | 2947531 | A1 * | 1/2011 | B65C 9/40 |
| WO | 2008046526 | A1 | 4/2008 | |

OTHER PUBLICATIONS

Bamberger Steffen, Simon Rainer, Brandt Michael, Van Rens Joseph Johan Ma, Packaging Machine With a Labelling Device, English Abstract of WIPO Patent Publication WO2008046526, Apr. 24, 2008, European Patent Organization, http://www.epo.org/searching/free/espacenet.html.

Schwarz K., Process and device for production of labels and transfer of labels onto an object to be labelled, English Abstract of European Patent Publication EP1002730, Mar. 10, 2004, European Patent Organization, htip://www.epo.org/searching/free/espacenet.html.

Video of Bizerba GLM-P Labeller, viewable at the following web address: http://www.youtube.com/watch?v=n6sW-_gOzwA.

Labelling Technologies Print and Apply Vacuum Drum Double Axis (VDR-2AXIS) pallet labelling system, viewable at the following web address: http://www.youtube.com/watch?v=pAmPZD3IRW0.

* cited by examiner

CONTAINER LABELING SYSTEMS AND METHODS OF USE

FIELD OF THE INVENTION

The present invention relates to placing labels on containers, and more particularly to systems, methods and apparatus for applying labels to each individual container within a group of container stacks (e.g., containers on a pallet) without removing the containers from the stack.

DISCUSSION OF THE BACKGROUND

Various types of goods can be stored and transported in containers loaded onto pallets. Pallets typically carry "three-dimensional" arrangements of containers, where the containers are arranged in vertical stacks, and multiple stacks or columns are grouped together in a square or rectangular arrangement defining multiple horizontal rows. An exemplary column may include 10 vertically stacked containers, and if 2 such stacks are grouped together, the matrix of containers would be 2×10. It is to be appreciated that different numbers of containers may be provided in a given column based on container size, with columns of smaller containers having more containers than columns of larger containers. Similarly, different numbers of columns may be grouped together. Thus, a wide range of matrices of containers may be provided, including without limitation 2×6, 3×6, 4×6, 2×10, 3×10, 4×10, 2×12, 3×12, 4×12, etc., etc. The palleted containers are often stretched wrapped or otherwise secured for storage and transport. Identification of the goods stored within the palleted containers is critical to properly route, store, and keep track of the goods provided within the containers, whether they be stored in a warehouse or at a customer facility, or temporarily housed at a distribution center. Printed labels may contain information pertinent to the product or goods loaded onto the pallet, such as the product identification number, the pallet identification number, the quantity of the goods in each container, the lot number, the customer to which the container has been sold, a date (e.g., a date of manufacture, a shipping date, an expiration date, etc.), and customer or order data and routing codes. Proper identification and records are particularly important with respect to produce and other agricultural goods, since they are perishable.

Current techniques for labeling containers that are packed together and situated on a pallet (e.g., in packed fruit boxes, etc.) are slow and labor intensive. Typically the containers are manually, individually labeled. In other techniques, the containers may be unstacked from the pallet ("depalletized") and sent though conveyor system that is capable of labeling one box at a time. In still other techniques, the pallet may be labeled, but the containers are not individually labeled. New and better systems and methods are needed to increase the speed and efficiency of labeling palleted containers.

It is therefore desirable to provide methods and apparatus for automatically individually labeling containers as they are stacked in a three-dimensional arrangement (e.g., on a pallet) without the need for the stacked containers to be removed or unstacked.

SUMMARY OF THE INVENTION

Embodiments of the present invention provide apparatuses, machines, systems and methods for applying labels, identification and other information to individual containers organized in one or more stacks. The methods, apparatuses and machines of the present invention may use one or more labeler(s) and/or printer(s) (generally referred to as "applicator(s)") mounted on a frame or support system that is capable of applying an adhesive label and/or print information directly on each container in a group of stacked containers (e.g., containers loaded on a pallet) that may be arranged in various combinations of columns and rows (e.g., a 1×2, 2×2, 2×3, 2×4 and other arrangements of columns with at least 2 containers in each column, irregular arrangements with a 2×2 arrangement adjacent to a 1×2 arrangement with at least 2 containers in each column, and other arrangements as described herein and as used in industry to ship goods). The applicator(s) of the apparatuses of the present invention may be movable in at least one dimension, to facilitate positioning the applicator(s) at each container in the group of stacked containers. The methods, apparatuses, and machines of the present invention may position the applicator(s) at each container by moving each of the applicator(s) along a vertical track at a "labeling station" and by moving the grouped, stacked containers through the labeling station on a conveyor, which may sequentially move the stacked containers to multiple positions in the labeling station to allow each of the containers to be positioned in front of the applicator(s) and labeled by the applicator(s). In other embodiments, the applicator(s) may apply labeling to each container in a group of stacked containers (e.g. containers loaded on a pallet) positioned at the labeling station by moving the applicator(s) in two dimensions (along an X-Y plane) in order to move from container to container within a group of container stacks and apply labeling or printing to each container. In some embodiments of the invention, the apparatus or machine may include a frame or support structure having two or more printers and/or labelers mounted thereon. Additionally, the methods, apparatuses and machines may have or use a mechanism for moving at least a part of the printer and/or labeler in and out (along a Z axis) to allow the applicator(s) to reach out to the containers to apply a label and/or print directly on the container.

The present invention is particularly useful for labeling palletized shipping and storage containers. Various types of shipping and storage containers require labeling and coding after they have been stacked on a pallet for shipping. Other containers simply require generic, branded or even blank labels to be attached (that may be further labeled at a later time). For example, a recipient of such containers often needs to apply information and coding to the individual containers (e.g., for storage, routing, or further shipping purposes) before they need to be depalletized. Removing the containers from a pallet is a time consuming and labor intensive process, which may delay the ultimate delivery of the pallet to its destination, and which may also expose the contents of the containers to unnecessary adverse environmental conditions (such as the heat of a summer day). Maintaining the containers on a pallet is efficient and cost-effective for storing and organizing such containers. The present invention allows for the individual labeling of such palletized containers without the need to individually label the containers by hand or to depalletize the containers. Thus, the present invention provides important efficiencies to the many industries that utilize palleted container shipping, as well as other industries where efficient labeling of stacked units is desirable.

There are various embodiments encompassed in the present invention, including labeling systems that are capable of applying labeling or printing to each container in various three-dimensional arrangements of containers, including multiple stacked columns of containers (each column including anywhere from 1 to 12 or more stacked containers), where such columns are arranged next to each other in 1×2, 2×2, 3×2, 2×4, 3×4, other irregular groupings such as nested arrangements of containers, multiple columns of containers of different sizes (e.g., a 1×2 arrangement of containers of one size paired with one column of containers of a second size, the second size being twice the width of the first size) together in a square or rectangular pattern, and including various other arrangements of containers. The labeling systems of the present invention may have one or more applicators in order to enable quick and efficient labeling of each individual container in various arrangements of stacked container. For example, an exemplary labeling system may include two applicator systems, one on each opposite side of a pallet, for labeling containers on such opposite sides, in which case the labeling system can apply labels to or print simultaneously on any arrangement of stacked containers that is two columns wide (e.g., 2×2 arrangements, 2×3 arrangements, 2×4 arrangements, etc.) with one pass through the labeling station without the need to rotate or otherwise manipulate the containers or the labeling system to reach each of the containers in the arrangement. In another exemplary embodiment, the labeling system may have a single label applicator, in front of which multiple sides of the pallet may be positioned to allow each container on the pallet to be labeled. In another exemplary embodiment, two applicator systems may be provided on the same side of a pallet.

Embodiments of labeling systems of the present invention may include a processing unit that may be in electronic communication with various sensors, encoders, motors (e.g., motors driving the applicator systems and a conveying system) in the labeling system. The processing unit may also have an internal memory for storing various pre-loaded reference data describing one or more of the possible geometric arrangements of the containers to be labeled. Such pre-loaded reference data may include the size of the individual containers, the number of such containers in an individual stack of containers, number and geometric arrangement of the stacks of containers, and the location(s) on each individual container where a label and/or printed information should be applied to the container, etc. The processing unit may be electronically connected to a human interface device (e.g., a touchscreen; a combination of a keyboard, mouse, and a video monitor, etc.) for selecting the appropriate pre-loaded reference for the particular geometric arrangement of containers that corresponds to the geometric containers that are to be passed through the labeling system. The processing unit may also be configured to store data related to labeling applied by the labeling system to a specific pallet. As discussed herein, palleted or otherwise grouped containers may be labeled prior to storage, shipping, or other purposes. It may be important that the storage location, shipping destination, or other information regarding the containers is tracked and/or recorded in a retrievable form (e.g., as data in an electronic database) so that the containers are not lost, misrouted, etc. The processing unit may store data regarding specific containers that have been labeled by the labeling system. The processing unit may additionally or alternatively transmit data regarding labeled containers to a separate processing or electronic storage unit (e.g., an office computer, server, etc.).

Embodiments of labeling systems of the present invention may include a conveyor upon which a pallet or other group of container stacks may be placed for movement through the labeling system. The conveyor may have one or more motors connected thereto for driving the conveyor and moving the geometric arrangement of containers, and the processing unit may be in electronic communication with the one or more motors. The conveyor may also include one or more encoders and sensors in electronic communication with the processing unit to track the position of the pallet and/or the stacks of containers. The processing unit may use the data provided by the one or more encoders and sensors to precisely control the one or more motors and thereby precisely control the movement of the conveyor and the position and movement of the containers. In some embodiments, the conveyor may provide sequential, stepwise movement of the containers through the labeling station so that the applicator(s) may have access to each container and apply a label or printing thereto. For example, in some implementations, the labeling apparatus may be labeling containers arranged in a 2×4 arrangement of container stacks (e.g., at least two containers high) on a pallet, where the containers are arranged such that the pallet carries rows of two container stacks across the width of the conveyor and there are four rows along the length of the conveyor. In such implementations, the conveyor may "park" the leading row container stacks in front of the applicator(s) in the labeling station to allow the labels or print to be applied to each individual container in the leading stacks, then the conveyor may advance the pallet such that the second row of container stacks are parked in the labeling station and are labeled, then the third row of stacks, and then the fourth row of stacks. The sequential advancement of the pallet allows each individual container loaded on the pallet to be placed in front of the applicator(s) in the labeling station and to be labeled. In other embodiments, the conveyor may park the pallet in a single stopping position in the labeling station, and the applicator(s) may move to each container on the pallet and applying labeling or printing without the need for sequential advance of the conveyor.

In embodiments of the invention, one or more applicator systems of the labeling system may be configured to apply labels (e.g., adhesive labels) to the containers or to print directly on the containers. Such labels may be blank, generic, or include pre-branding (trademarks) related to the commodity in the containers. The applicator systems each include an applicator that is capable of applying a label to and/or directly printing onto each container. Exemplary applicator systems may be capable of moving an applicator in one or more dimensions (e.g., vertical and/or horizontal x-y movement, and/or horizontal z-directional movement toward the containers). Exemplary applicator systems may include at least one motor or actuator for each direction of movement. For example, in some embodiments the applicator system may have a vertical track and a carriage that moves along the vertical track. The carriage may be moved along the vertical track by a drive element such as chain, belt, a ball screw, or other flexible or positive drive element driven by one or more motors connected thereto. The applicator may be mounted on the carriage and move with the carriage. The processing unit may be in electronic communication with the one or more motors. The motor or the carriage may have one or more encoder(s) mounted thereon that are also in electronic communication with the processing unit. The processing unit may use the data provided by the one or more encoder(s) to precisely control the one or more motors thereby precisely controlling the movement of the carriage carrying the applicator and the position of the applicator. Using data from the encoder(s) for the conveyor, data from the encoder(s) for the one or more applicator systems, and pre-loaded reference data stored in the internal memory of the processing unit, the processing unit can precisely direct the one or more applicator systems to move and apply labels and/or print to each individual container in an arrangement of stacked containers.

In embodiments of the invention, one or more applicator systems may include an applicator arm for extending a label applicator, printer, or printer head laterally toward the stacked containers (e.g., in the z direction). For example, the applicator may include a label applicator mechanism that receives printed labels from a label printer also contained within the applicator, and an applicator arm that extends the applicator mechanism toward a container to apply the label to a predetermined position on a container. The applicator mechanism may include a label pad that is pivotally mounted to a distal end of an applicator arm. The label pad may be positioned to receive a printed label from the label printer, and subsequently extended toward a container to apply the label to the pre-determined position on the container. In other embodiments, a printer system (e.g., an inkjet printer) may be mounted on the applicator arm that is capable of moving the printer head in one or two dimensions independently of the carriage and the applicator arm, allowing the printer to print one or more lines of text on the container once it is position in front of a container. In other examples, a printer head (e.g., an inkjet printer head) may be attached to the distal end of the applicator arm. The printer head may be mounted on a printer carriage capable of moving in one or more dimensions (e.g., in the horizontal direction). In some implementations, the applicator may be configured to move the printer head in two dimensions, allowing the printer print multiple lines text of varying lengths.

An exemplary applicator arm may have a motor or actuator connected thereto for driving the movement of the applicator arm, and the motor may be in electronic communication with the processing unit. The applicator arm may have a sensor (e.g., an proximity sensor, such a radar, sonar, ultrasonic, optical, etc.) mounted thereon to determine distance between an end of the applicator arm and the surface of the container, and/or the position of a given container. The sensor may also be in electronic communication with the processing unit, allowing the processing unit to precisely control the position of the applicator arm.

The labels and/or information printed on the individual containers may be generic, may include trademarks (product branding), or may include various types of identification information (e.g., a date of manufacture, a shipping date, an expiration date, a source identifier, an individual tracking code, etc.). The processing unit may be configured to apply identification information to each container that is specific to the particular grouping of containers (e.g., a particular arrangement of containers grouped together on a pallet) and/or identification information specific to each container. For example, the identification information applied to a particular container may include information that is common to each container in the grouped stacks of containers (e.g., source information, arrival date, destination, etc.) as well as information unique to the individual container (e.g., a specific identification number for the particular container for tracking purposes). For example, a human operator may input specific information to be included in all the labels or printed data that are to be applied to containers (e.g., source information, arrival date, destination, storage location, etc.). Additionally or alternatively, the processing unit may automatically generate identification codes and other data (e.g., date, time, unique identification codes, etc.) to be printed on the labels or directly on the containers. Alternatively, the labels applied may be generic (e.g., "California apples") or they may include trademarks, brands or other source identification information.

The various embodiments of the present invention may be used to apply labels and/or printing to various structures and containers that may be organized into tight grouping of stacked columns (e.g., shipping containers, agricultural bins, storage bins and boxes, etc.). The embodiments of the present invention are particularly helpful in labeling individual containers or other structures that are loaded on a pallet. The present invention can be used to label individual containers or other structures stacked on the pallet (e.g., stacked in multiple columns or stacks) without the need to depalletize the containers or other structures.

In certain embodiments, the present invention relates to a system for applying labels or directly printed information onto individual containers in a stacked arrangement, including a first applicator system having a first vertical member having a track thereon and a first motion imparting member along the track, a first carriage connected to the first motion imparting member for moving the first carriage along the first vertical track, and a first applicator mounted on the first carriage; a second applicator system having a second member having a second vertical track thereon and a second motion imparting member along the track, a second carriage connected to the second motion imparting member for moving the second carriage along the second vertical track, and a second applicator mounted on the second carriage; a conveyor located between the first applicator system and the second applicator system, wherein the conveyor is configured to sequentially position stacked containers between the first and second applicator systems, and the first and second applicators are configured to move vertically along the first and second tracks and apply labels or print onto individual containers of said stack; and a processing unit in electronic communication with the conveyor, the first carriage, the second carriage, the first applicator, and the second applicator, and configured to control the positions of the conveyor, the first carriage, and the second carriage, and to operate the first and second applicators.

In certain embodiments, the present invention relates to a system for applying labels or printed information to individual containers in a stack that includes at least one applicator system having a track, a carriage movably mounted on the track, wherein the carriage is connected to a mechanism for moving the carriage along the track, an extension system on the carriage for extending out from the carriage and retracting back toward the carriage; an applicator mounted on the extension system; a conveyor located adjacent to the track for positioning stacked containers into alignment with the track, and the at least one applicator is configured to move along the track and apply labels or printing to individual stacked containers; and an electronic system for controlling the position of the conveyor, the at least one carriage, and the extension system, and for operating the actuator.

In other embodiments, the present invention relates to a labeling system that includes a frame system that includes a retractable carriage; at least two applicator systems mounted on the retractable carriage, where the system includes a first applicator system mounted on one side of the carriage and a second applicator mounted on a second side of the carriage (that may or may not be opposite from the first side of the rack); a conveyor that passes through the frame system, where the carriage is coupled to the frame system at a track that runs vertically above the conveyor and the carriage can be lowered over the conveyor and retracted vertically away from conveyor; a processing unit for controlling the movement of the conveyor, the position of the carriage, and the applicator systems. The at least two applicator systems of this embodiment may include a third applicator system, and may also include a fourth applicator system, where the third applicator system may be located on a third side of the carriage and the fourth applicator system may be located on a fourth side of the carriage that is opposite from the third side of the carriage. In such embodiments, the labeling system can attached labels or directly print on all four sides of a grouped arrangement (e.g., palleted) of columns of stacked containers, and can therefore accommodate patterns of stacked containers that have irregular arrangements, nested arrangements, and other arrangements that require that require the applicators to access more than one or two sides of the arrangement in order to reach each individual container.

In other embodiments, the present invention relates to an apparatus for marking items that includes a vertically oriented support member having a track located along a portion of a side of the member, the track having a vertical motion imparting member therein; a support carriage movably engaged with the track and attached to the vertical motion imparting member allowing the carriage to move along the track; a movable support member on the carriage that may be extended and retracted in a horizontal direction; an applicator unit located on the support member of the carriage; a conveyor located adjacent to the vertically oriented support member, the conveyor being capable of moving items located thereon in a horizontal direction; at least one sensor adjacent to the conveyor for determining the position of at least one item on the conveyor; and an electronic control unit in communication with the conveyor, the at least one sensor, the vertical motion imparting member, the movable support member and the applicator unit.

In other embodiments, the present invention relates to an apparatus for marking containers that includes a horizontally oriented support member having a horizontal track located along an upper surface thereof, the horizontal track having a horizontal motion imparting member therein; a vertically oriented support member movably engaged with the horizontal track and attached to the horizontal motion imparting member, the vertically oriented member having a vertical track located along a portion of a side of the vertically oriented member, the vertical track having a vertical motion imparting member therein; a support carriage movably engaged with the vertical track and attached to the vertical motion imparting member allowing the carriage to move along the vertical track; a movable support member on the carriage that may be extended and retracted in a horizontal direction; an applicator unit located on the support member of the carriage; and an electronic control unit in communication with and for operating the horizontal motion imparting member, the vertical motion imparting member, the movable support member and the applicator unit to mark individual containers of a group of containers.

In further embodiments, the present invention relates to a method of labeling stacked containers, including placing at least two stacks of containers on a conveyor, where the at least two stacks of containers comprises a first stack of containers and a second stack of containers arranged side-by-side in a first lateral row across the width of the conveyor; moving the at least two stacks of containers to a labeling station, where the labeling station comprises a first applicator system and a second applicator system, the first applicator system and the second applicator system being on opposite sides of the conveyor; and applying identification information to each container in the at least two stacks of containers, where said first applicator system applies the identification information to each of the containers in the first stack of containers and the second applicator system applies the identification information to each of the containers in the second stack of containers.

In further embodiments, the present invention relates to a process of marking containers comprising the steps of moving at least one stack of containers such that a first group of the containers is located adjacent to a movable marking apparatus; moving a carriage having an extendable member thereon in a vertical direction adjacent to the group of containers until an endmost container of the group is detected, the extendable member supporting a marking apparatus; and moving the extendable member away from the carriage toward the group of containers, marking a container of the group using the marking apparatus, and retracting the extendable member away from the group of containers.

The embodiments of the present invention may be implemented to apply labeling and/or print to various structures that are stacked and grouped into various arrangements (e.g., multiple rows of stacked columns). For example, and without limitation, embodiments of the invention may be implemented in applying identification information by application of labels to stackable containers packaged on pallets for shipping or storage. The embodiments of the present invention allow information (e.g., identification numbers, shipping origins, shipping destinations, manufacturing dates, lot numbers, organizational codes, etc.) to be applied to each individual container or structure stacked on a pallet or otherwise grouped together without the need to break down the stacked arrangement of the containers or structures.

It is therefore an object of the present invention to provide labeling methods, apparatus, and systems that can efficiently apply printed labels or directly printed information to each individual container in pre-grouped (e.g., palleted) arrangements of containers without the need to break down (e.g., depalletize) the containers. It is also an object of the present invention that the labeling system can accommodate various geometric arrangements of multiple and/or non-uniform stacks of containers.

It is also an object of the present invention to provide an automated means and methods for applying identifying information to palleted containers such that recipients of palleted containers can apply information to each container on a pallet for the purpose of organizing, storing, and/or reshipping the palleted containers without having to manually label each container or depalletize the containers.

It is also an object of the present invention to provide label application methods, apparatus, and systems that can apply labels to and/or directly print information on various stacked arrangements of structures using a pre-determined pattern stored in a processing unit.

It is also an object of the present invention to provide label applicator methods, apparatus and systems that can apply labels to and/or directly print information on at least two sides of grouped arrangement of containers without the need to rotate the grouped stacks of boxes or to move an label applicator or printer around to multiple sides of the arrangement of containers. Embodiments of the present invention allow the application of labels to each container in an arrangement of containers to be quickly and efficiently labeled.

It is also an object of the present invention to provide label applicator methods, apparatus and systems that can be implemented into a conveyor system (e.g., a belt conveyor), allowing pallets of containers to be unloaded from trucks or other vehicles and placed on the conveyor and immediately labeled without the need for intermediate steps or delays.

Additional objects of the invention will be apparent from the detailed description and the claims herein.

DETAILED DESCRIPTION OF THE EXEMPLARY EMBODIMENTS

Reference will now be made in detail to certain embodiments of the invention, examples of which are illustrated in the accompanying drawings. While the invention will be described in reference to these embodiments, it will be understood that they are not intended to limit the invention. To the contrary, the invention is intended to cover alternatives, modifications, and equivalents that are included within the spirit and scope of the invention as defined by the claims. In the following disclosure, specific details are given to provide a thorough understanding of the invention. However, it will be apparent to one skilled in the art that the present invention may be practiced without these specific details.

Container Arrangements

The labeling apparatus, systems, and methods of the present invention may be configured to apply labels and/or directly print onto each individual container in various groupings or arrangements of containers (e.g., containers loaded on a pallet). Different industries and companies use various arrangements of containers (e.g., cases, boxes) to store or ship their goods, and embodiments of the present invention provide labeling apparatus, systems, and methods capable of labeling individual containers in such various arrangements.

Figure 1:
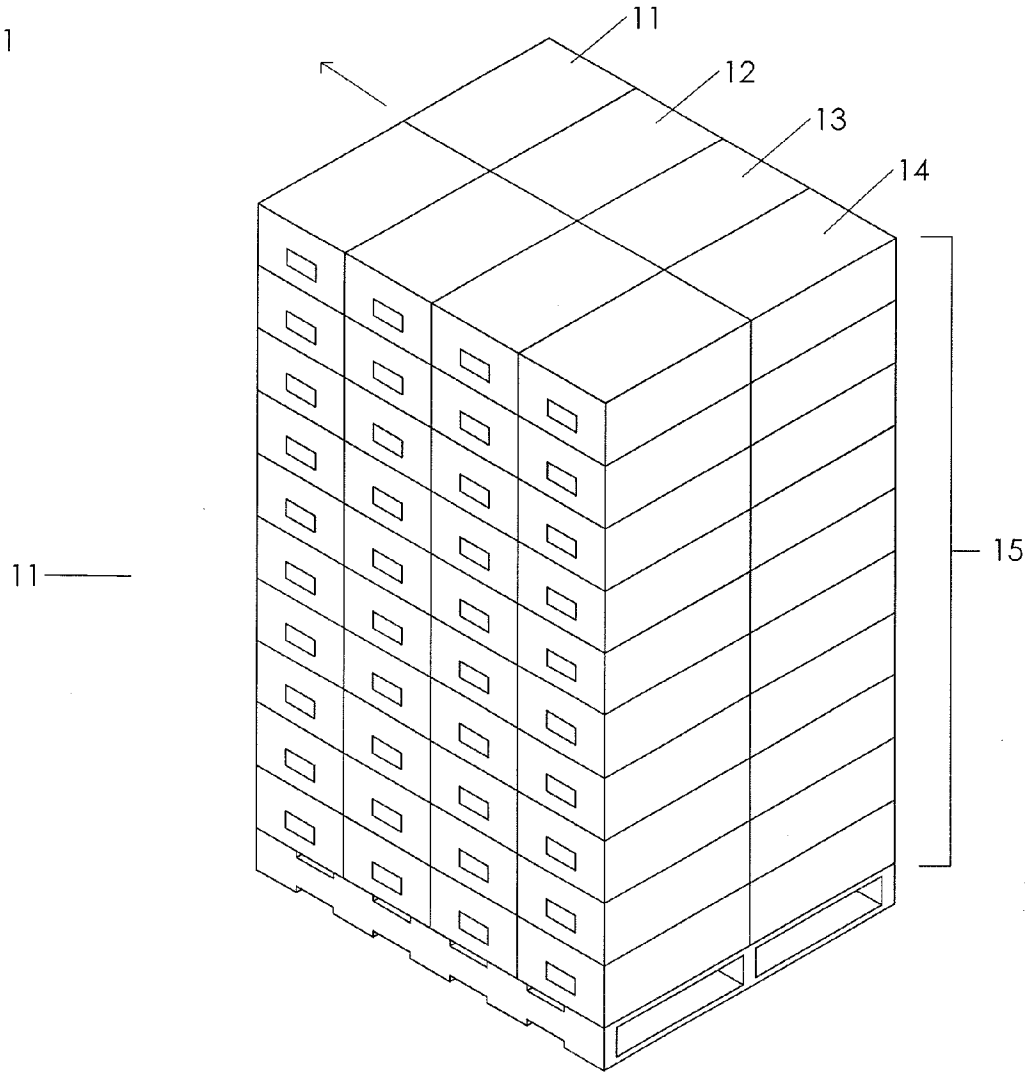
FIG. 1 is a perspective view of a regular pattern of containers arranged on a pallet.

Typically, containers may be arranged in regular vertical columns or stacks, and multiple columns or stacks may be grouped together in a cubic or other rectangular cuboid arrangement, where the columns or stacks have the same number of containers (such arrangements are referred to herein as "regular arrangements"). FIG. 1 shows and example of such an arrangement (11), which is on a pallet. In FIG. 1, a set of containers having eight columns or stacks (15), each having ten containers therein, is arranged into a 2×4 arrangement of columns, creating a rectangular cuboid shape. The arrangement of containers includes four rows of two (rows 11, 12, 13, and 14). The arrow shown in FIG. 1 shows the direction in which the pallet may be passed through an exemplary labeling station of the invention. In such an example, the pallet may be passed through a labeling system having a conveyor and two applicator systems flanking the conveyor. The conveyor may advance the pallet to the labeling system, where the applicator systems may apply labels and/or printing to the lateral sides of each individual container on the pallet (see, e.g., the labels shown in FIG. 1). The labeling systems of the present invention may also be configured to apply labeling to individual containers in other regular arrangements of containers (e.g., stacks arranged in 2×1, 2×2, 2×3, 2×4, 2×5, 2×6, etc.).

Figure 2:
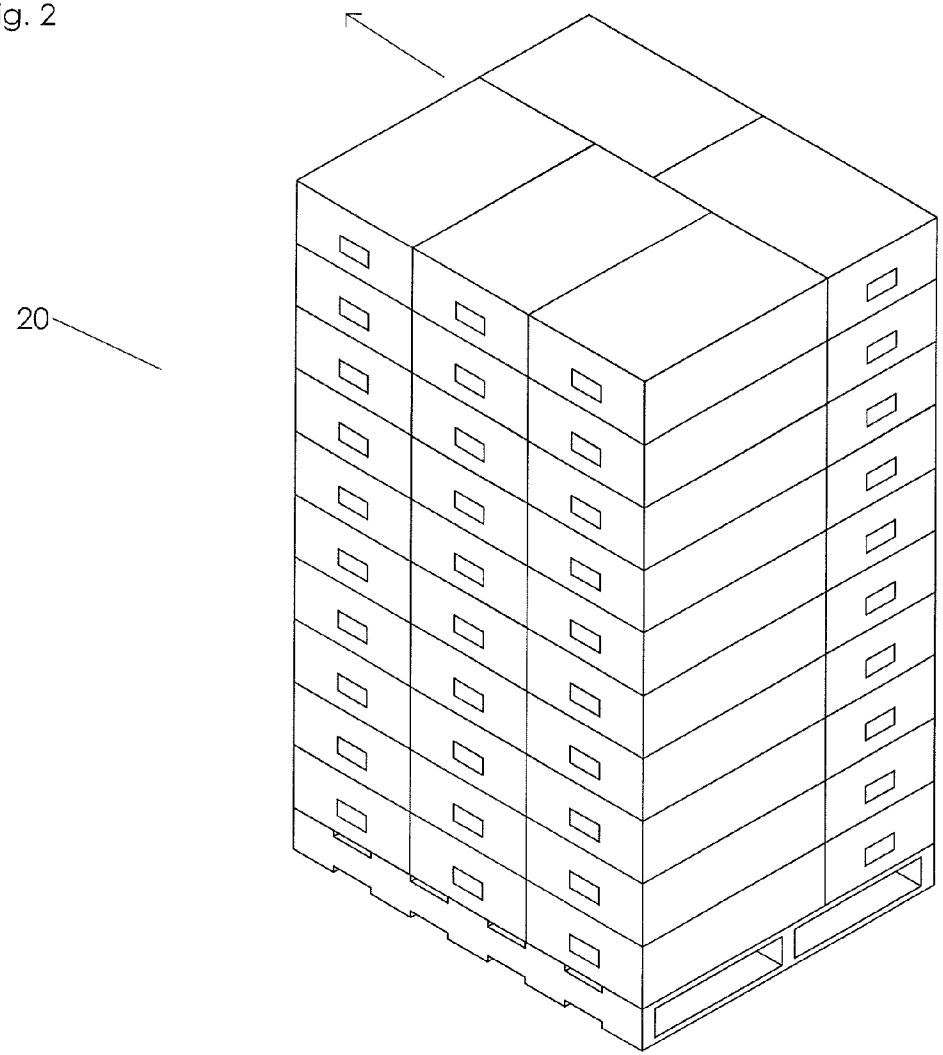
FIG. 2 is a perspective view of an irregular pattern of containers arranged on a pallet.

Although containers may be stacked in regular arrangements, several other patterns of stacked containers that may be utilized for shipping and storage. In some examples, there may be uniform stacks of containers, but they may not be arranged in regular rows (herein referred to as "irregular arrangements"). For example, FIG. 2 shows uniform stacks grouped together without a consistent row pattern in arrangement 20. Each of the stacks has ten containers, but two of the stacks are turned 90° relatively to the other three stacks (1×3+1×2). The arrow in FIG. 2 indicates the direction by which the pallet may be passed through an exemplary labeling system. It can be seen that the stacks of containers on each side of the pallet must be addressed differently in order to apply labels to the containers at a consistent position on each container. Embodiments of the present invention are capable of applying labels to various irregular arrangement of container columns (e.g., 1×3+1×2, 2×2+1, 2×3+1×2, etc.). Various embodiments of the present invention are configured to apply labels to such irregular arrangements of containers (e.g., three-sided or four-sided labeling systems).

Figure 3:
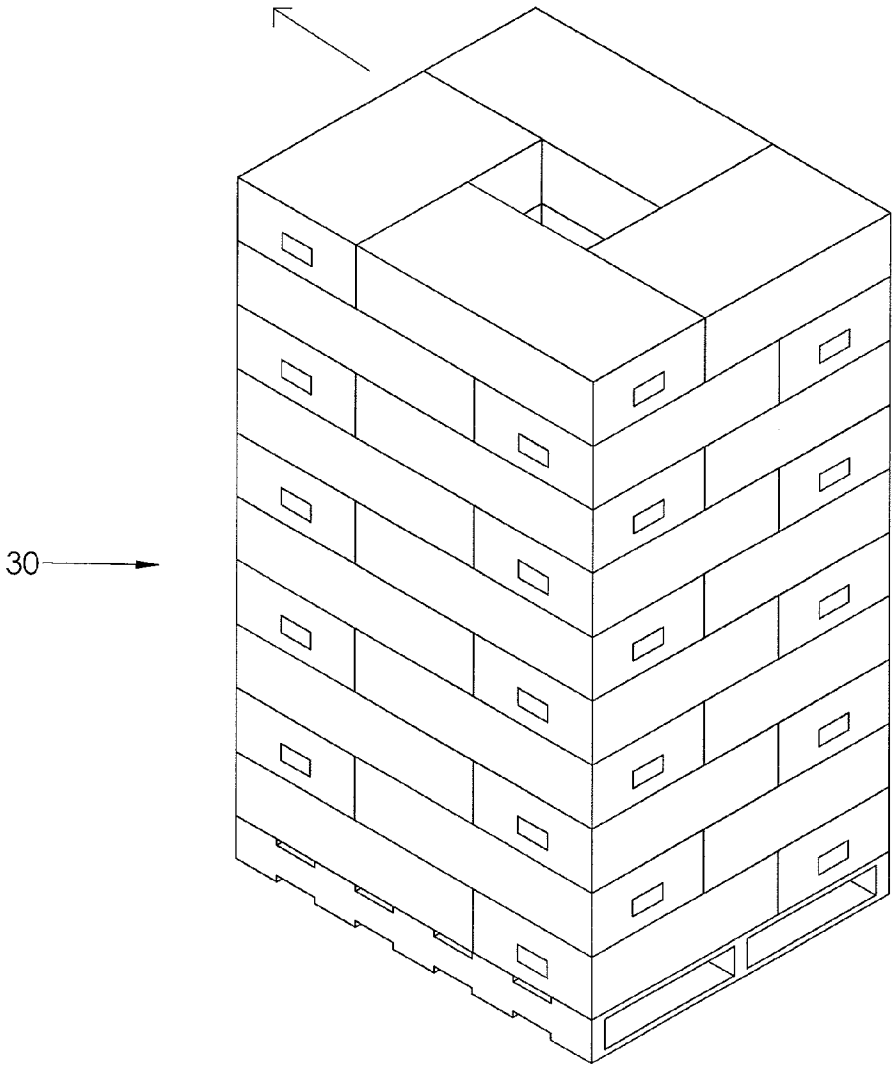
FIG. 3 is a perspective view of a nested pattern of containers arranged on a pallet.

The present invention may also be configured to apply labels to irregular container arrangements that do not have uniform stacks of containers. Sometimes containers may be stacked in nested patterns that do not include uniform stacks, as illustrated in FIG. 3 (herein referred to as "nested arrangements"). It is to be appreciated that embodiments of the invention are capable of automatically labeling such nested arrangements of containers. In most situations where irregular stacking of containers occurs, the method and manner of such stacking is known in advance, so the positions of the containers are also known (e.g., containers may have a given offset from each other in adjacent rows, much like bricks are offset in different tiers of a wall). In these situations, the positions may be provided in the pre-loaded reference data to the processing unit, which will cause the exemplary labeling devices and/or pallet conveyors to move according to the known positions of the containers in order to efficiently label them.

For example and without limitation, FIG. 3 shows containers on a pallet stacked in an offset, nested manner, such that containers on alternating tiers are uniformly offset from each other (akin to bricks on a wall). In some nested arrangements, the containers may be stacked around the perimeter of the arrangement (e.g., the edge of the pallet), with no containers present on the interior of the arrangement. When the leading edge of such containers on a pallet reaches the labeling station, the applicator system may travel in a vertical direction, but only applying labels to every other container. Once this is accomplished, instead of advancing the distance of a full container length, the conveyor (or the applicator system) may be advanced horizontally only half of this distance before stopping again. At this point, the applicator system again travels in a vertical direction, this time applying labels to the containers that were skipped in the first pass of the applicator. Once the second set of labeling is accomplished, the conveyor (or the applicator system) again advances horizontally only half the distance of a full container length before stopping, at which point the applicator system again applies labels to every other container, and so on.

It is to be appreciated that the exemplary embodiments of the present invention are capable of providing labeling on non-uniformly stacked containers by adjusting the horizontal and vertical positioning of the applicator system(s) according to the expected positions of the containers. In those situations where the positions of the containers are not uniform, or not in an expected arrangement, an operator may input the positions into the system, which has programming to efficiently move the conveyors and/or applicator systems in order to label each such container.

Exemplary Labeling Systems and Methods of Use

Referring to the drawings of the exemplary embodiments of FIGS. 4-15, wherein like reference characters designate like or corresponding parts throughout the several views, it is seen that these embodiments include a labeling system for applying labels or directly printed characters to exterior surface(s) of containers grouped together in multiple stacks.

Figure 4:
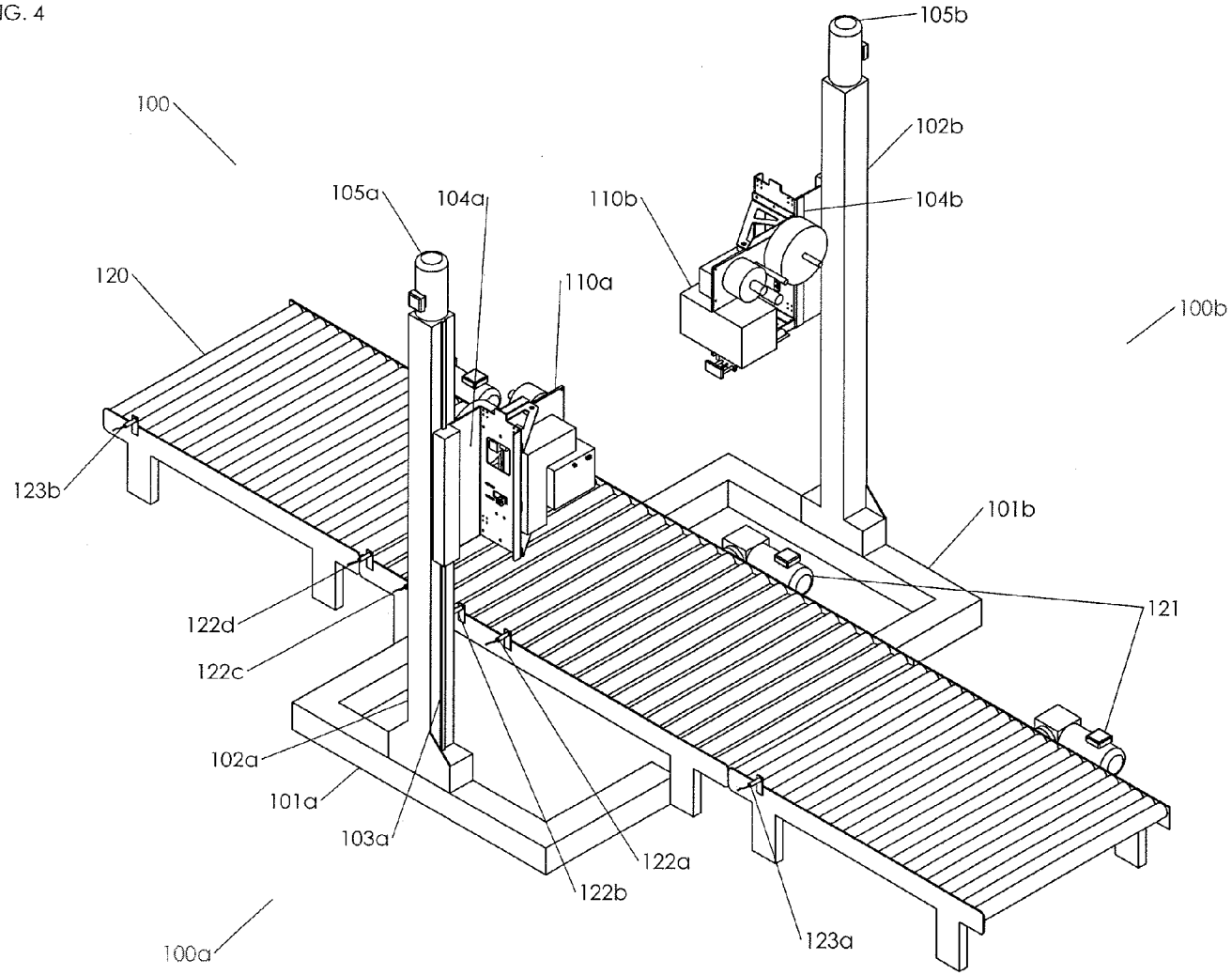
FIG. 4 is a perspective view of a label applicator system according an embodiment of the invention.

In the embodiment illustrated in FIG. 4, an exemplary labeling system 100 includes two oppositely positioned applicator systems 100*a* and 100*b*, each having the same or similar components and elements therein. In the interest of simplicity and brevity, the components and elements of the applicator systems 100*a* and 100*b* will be described collectively without reference to the "a" and "b" designations present in the figures. Each of the exemplary applicator systems illustrated in FIG. 4 includes a support frame 101 having a vertical support member 102. The support frame 101 is positioned in proximity to a horizontal conveyor 120, upon which a regular, irregular, nested, or other arrangement of containers may be placed. The vertical support member 102 has a vertical track 103 and a conveying mechanism that includes a drive element 106 (e.g., a chain, a belt, a ball screw, piston, or other flexible or positive drive mechanism) that is engaged with a vertical track motor 105 for driving the movement of the drive element 106. The vertical track motor 105 may be various kinds of motors (such as an AC motor, a servo motor, etc.). A carriage 104 is connected to the drive element 106 and is guided by vertical track 103. The carriage 104 supports an applicator 110, which may include features configured to print and/or apply labels (e.g., adhesive labels) to containers in various positions, and/or print information directly on an exterior surface of a container.

In some implementations, it is preferred that the vertical track motor 105 be a servo motor having an encoder, which allows precise control of the movement of the conveying system and precise positioning of the carriage 104 and the applicator system 110. The use of a servo motor to drive the conveying mechanism 106 may allow for more reliable placement of labels or printed information on the containers.

The horizontal conveyor 120 of the embodiment of FIG. 4 may be motorized and enabled to advance the containers along the conveyor 120 toward the applicator systems 100*a* and 100*b*. The conveyor may have one or more motors 121 driving the conveyor system, which is shown to be a roller conveyor in FIG. 4, but may include another kind of conveyor in other implementations (e.g., a belt conveyor). In some implementations, and without limitation, the conveyor motors 121 may be basic AC motors. In such implementations, there may be multiple position sensors 122*a*, 122*b*, 122*c*, and 122*d*. The position sensors may be any of various kinds of position sensors, such as simple photosensors. The position sensors 122*a*, 122*b*, 122*c*, and 122*d* may be positioned along the conveyor 120 at various stopping points for the grouped stacks of containers along the conveyor 120. These stopping points are determined based on a particular arrangement of the grouped stacks of containers. For example, and without limitation, a regular arrangement of grouped stacks of containers may be an arrangement that is two stacks wide and two or more stacks long (e.g., 2×2, 2×3, and other various arrangements) on the conveyor 120. In such an arrangement, the position sensor 122*a* may be at a first stopping point for the grouped stacks of container, positioning the first, leading stacks of containers adjacent to applicator systems 110*a* and 110*b*; the position sensor 122*b* may be at a second stopping point, positioning the second stack of containers adjacent to the applicators 110*a* and 110*b*; the position sensor 122*c* may be at a third stopping point, positioning the third stack of containers adjacent to the applicator systems 110*a* and 110*b*; and the position sensor 122*d* may be at a third stopping point, positioning the third stack of containers adjacent to the applicator system 110. It is to be appreciated that more or fewer sensors 122 may be provided in other embodiments to allow for positioning more or fewer stacks of containers. It is also to be appreciated that the positions of sensors 122 may be uniform or non-uniform, depending on the position(s) of the containers (often dictated by container size/width) expected to be in the stacks on the conveyor. It is to be further appreciated that the positions of the sensors may be automatically or manually adjustable to compensate for different container arrangements that may be sent through the same system.

In other implementations, and without limitation, the conveyor motors 121 may be servo motors, motors with encoders, or the like which allow precise control over the movement and position of an arrangement of containers along the conveyor. In such implementations, the position(s) of exemplary sensors 122*a*, 122*b*, 122*c*, and 122*d* may not be necessary. It is to be understood that the applicator systems 100*a* and 100*b* may be arranged along the conveyor 120 such that the applicators 110*a* and 110*b* are aligned. However, in alternative implementations, and without limitation, the applicator systems 110*a* and 110*b* may be offset from one another (e.g., where a target label position for containers adjacent to applicator 110*a* may be at a front end of a container, whereas a target label position for containers adjacent to applicator 110*b* may be at a back end of a container).

Figure 5:
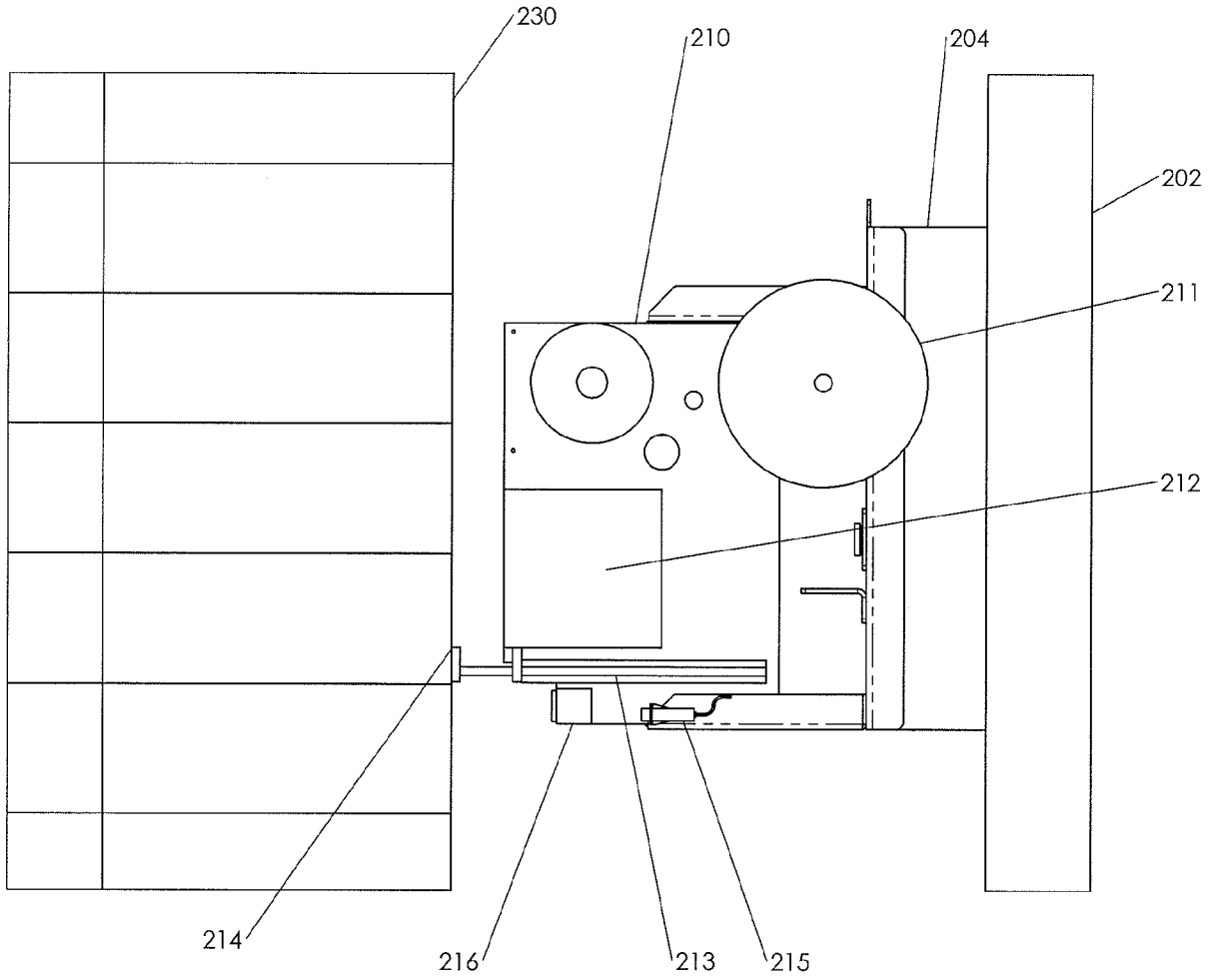
FIG. 5 is a side view of a label applicator according to an embodiment of the invention.

FIG. 5 shows an exemplary applicator system 210 of a labeling system (e.g., like the exemplary labeling system of FIG. 4). The applicator system 210 is mounted on a moveable carriage 204, which is guided by a vertical track (not shown) running vertically along vertical member 202. The applicator system 210 is positioned adjacent to grouped stacks of containers 230. The applicator system 210 may include several features, including a label spool 211 for providing labels (e.g., adhesive labels), a printer 212 (if necessary) for printing information on the labels, an actuator arm 213, and a label pad 214 for applying labels to the containers in the grouped stacks of containers 230. The labels may be fed through printer 212 (or, in embodiments that do not include a printer, by a drive wheel) from the spool 211, and then positioned in front of the label pad 214 where they are contacted and collected by the label pad 214. The label pad 214 may have holes or bores therein connected via tubing to a vacuum source, allowing the label pad 214 to apply vacuum pressure to the label and hold it in place. Once the label is positioned and held fast on the label pad 214, the actuator arm may be activated to extend the label pad 214 toward a container in the grouped stacks of containers 230 to apply the label to the container. In some implementations, and without limitation, the label pad 214 may have a pivoting head to accommodate irregularities in the surface of a container or a stack of containers that is not positioned perfectly parallel to the face of the label pad 214 (e.g., the stack of containers is on a skewed pallet).

In some implementations, and without limitation, the applicator system 210 may include a photosensor or other position sensor 215 to detect a leading edge of the grouped stacks of containers 230. In such implementations, the position sensor 215 may be in electronic communication with a processing unit that sends an electronic signal to stop a conveyor on which the grouped stacks of containers 230 is located in response to a signal from position sensor 215. Such a signal may be sent when a leading edge of the grouped stacks of containers 230 is reaches and trips the position sensor 215. In further implementations, the applicator system 210 may include a camera 216 for identifying a target location on a surface of a container for the application of a label. The target may comprise various marking that can be identified by the camera sensor.

In other implementations, and without limitation, the applicator system may include a printer head (e.g., an inkjet print head) or printer (e.g., an inkjet printer) mounted on an actuator arm. In such implementations, the printer head or printer may be able to move in one (e.g., in the horizontal) or two dimensions (e.g., in the vertical and horizontal) along a surface of a container to print one or more lines of text directly on the container.

Figure 6B:
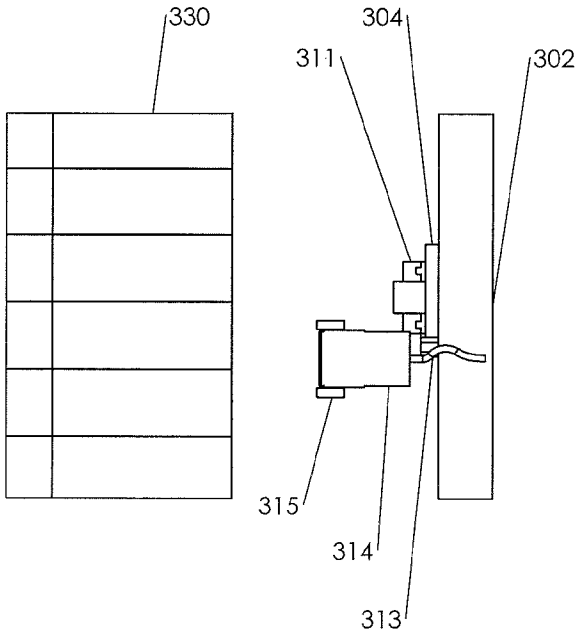
FIG. 6*b* is a side view of a printer system according to an embodiment of the present invention.
Figure 6A:
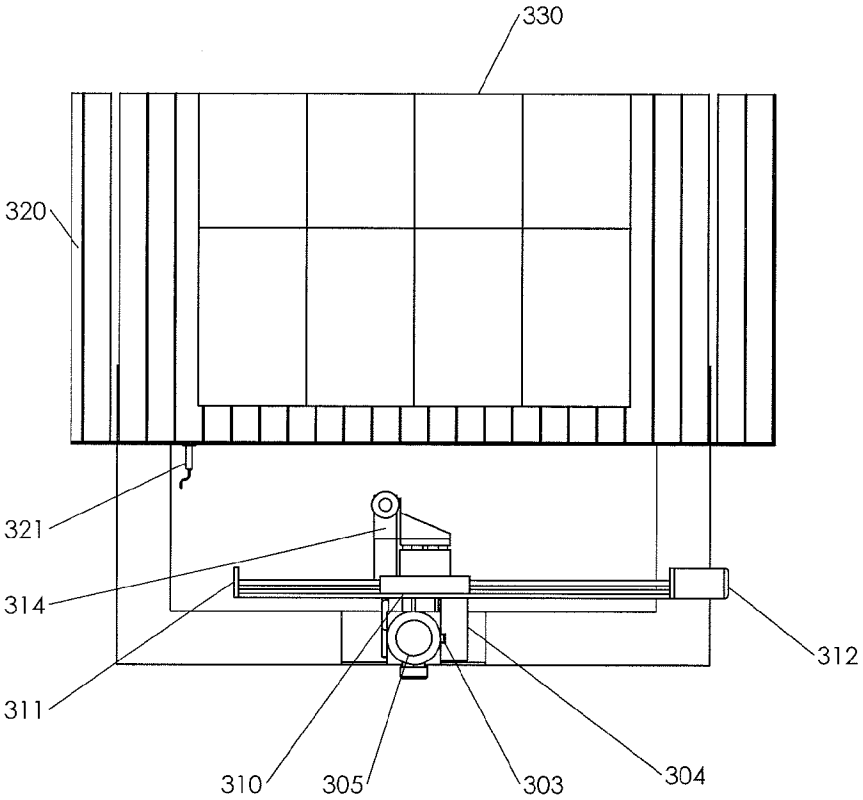
FIG. 6*a* is a top view of a printer system according to an embodiment of the present invention.

FIGS. 6*a*-6*d* illustrate an embodiment of the invention that includes a direct printing system 310. The printing system 310 may be part of an applicator system that includes a vertical support member 302, a vertical track 303, a carriage 304, a conveyor 306 and a vertical track motor 305, which may be similar to corresponding elements of the applicator systems 100*a* and 100*b* described above. The printer system 310 may be mounted on the carriage 304, allowing it to move up and down with the carriage 304 along the vertical track 303. The printer system 310 may include a printer track 311 on which a printer head 314 (e.g., an inkjet print head) may be movably mounted. A motor 312 may be connected to the printer head 314 to drive the movement of the printer head 314 along the track 311. The motor may be a stepper motor or other appropriate device that employs a drive element such as a belt, a chain, or other drive element to move the print head 314 along the track 311. The printing system may be located adjacent to a conveyor 320, allowing stacks of containers (e.g., grouped stacks of containers 330) to be positioned in proximity of the printer head 314 to allow printer head 314 to print directly on the containers. As shown in FIG. 6*a*, a position sensor 321 may be located at a stopping point for a grouping of containers, and may send a signal to a processing unit when it is tripped by the grouped containers 330.

As shown in FIG. 6*b*, the printing system 310 may include an actuator arm 313 attached to the printer track 311 configured to extend the printer head 314 outward toward the containers 330, allowing the printer head to print directly on target positions on each of the containers. The actuator arm 313 may include, without limitation, a linear actuator, which may be a hydraulic, pneumatic, electromechanical, or other type of linear actuator. The printer head 314 may be outfitted with rollers 315 for contacting the adjacent surface of containers 330, to allow the spacing between the printer head 314 and the containers. The rollers 315 may also allow the printer head 314 to smoothly roll along the surface of a container as it prints. FIG. 6*b* shows only two rollers 315, but the printer head 314 may be outfitted with 3 or more rollers in other implementations (e.g., implementations in which the printer head 314 is configured to pivot).

Figure 6D:
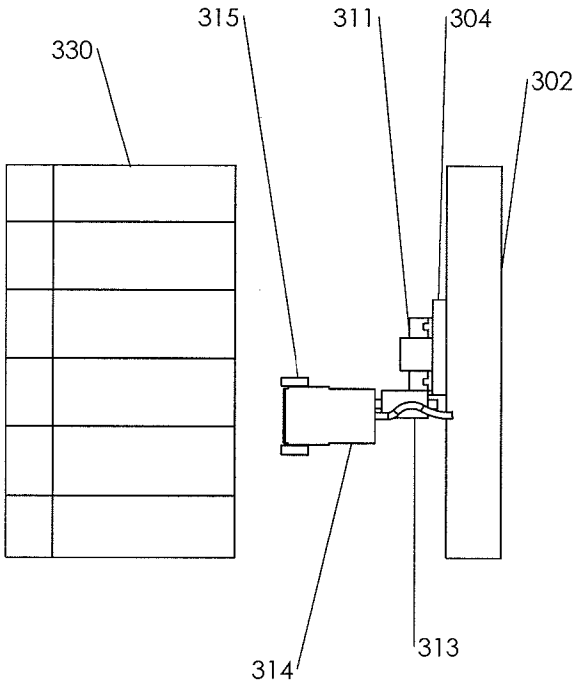
FIG. 6*d* is a side view of a printer system according to an embodiment of the present invention.
Figure 6C:
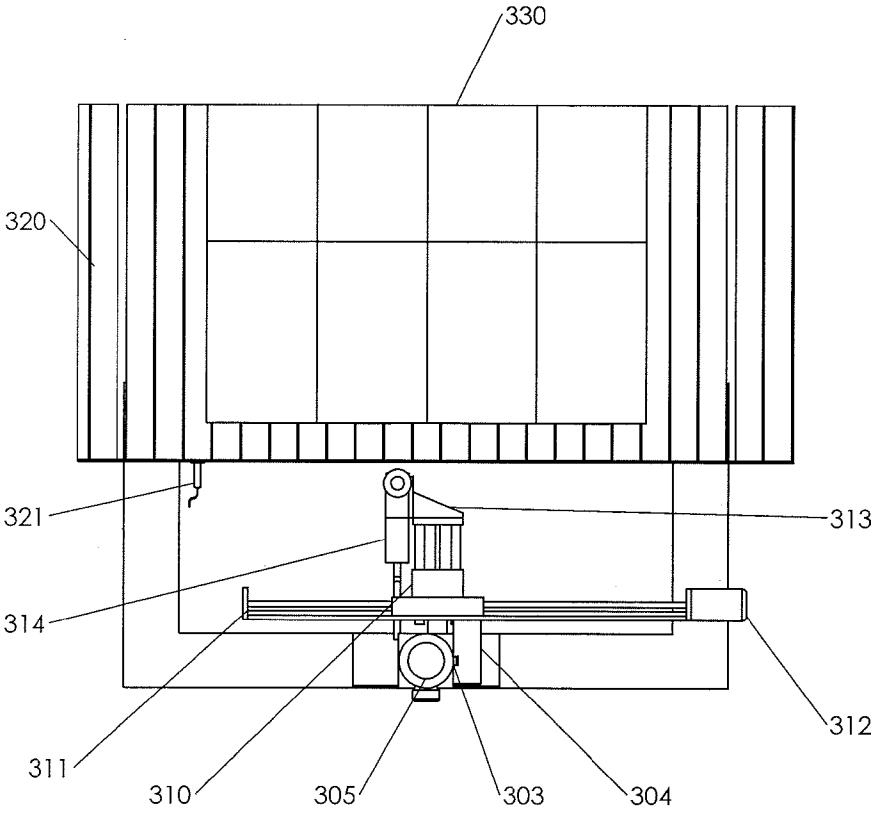
FIG. 6*c* is a top view of a printer system according to an embodiment of the present invention.

In some implementations, and without limitation, the actuator arm 313 extends the printer head 314 out from the printer track 311 toward the containers 330, as shown in FIGS. 6*c*-6*d*. The rollers 315 contact the proximate surface of the containers 330 placing the printer head 314 at a functional printing distance. In other implementations, and without limitation, the actuator arm 313 may extend the entire printer system 310 out from the carriage 304. The actuator arm 313 may also include a biasing system (e.g., without limitation, a compressible spring, or other mechanical buffer) that urges the printer head 314 to be extended outward, but which allows the printer head 314 to move in and out at varying distances. For example, and without limitation, the palletized or otherwise grouped stacks of containers may not always be loaded onto the conveyor (e.g., conveyor 320) in the same orientation (e.g., the distance between the containers 330 and the printer system 310 may vary), and the biasing system may provide leeway in accommodating containers at varying distances from the printer system. In other implementations, and without limitation, the actuator arm 313 may include a sensor to detect a distance between the printer head 314 and the containers 330, where the actuator arm 313 is configured to be extended at a controlled, variable distance depending on the position of the containers 330. In such implementations, the actuating mechanism of the actuator arm may be a servo or other AC motor controlled by a processing unit. Additionally, the printer head may be configured to pivot to accommodate containers that are skewed relative to the conveyor and the printer system.

As mentioned above, embodiments of the labeling systems of the present invention may also include a processing unit that may be in electronic communication with the various other components and elements of the labeling system. The processing unit may be a programmable logic controller or other computing device having software adapted to control the various elements of the labeling system. The processing unit may be in electronic communication with the motors driving the conveyor (e.g., motors 121), the conveyor mechanisms of the vertical track (e.g., motors 105*a*, 105*b*), and the motors with the applicator (e.g., the actuator arm, and the stepper motors or other types of motors driving the printer, and/or the motors driving the label feeder). The processing unit may also be in communication with various sensors within the labeling system, including position sensors (e.g., position sensors 122*a*, 122*b*, 122*c*, 122*d*, and 215), encoders associated with various motors within the labeling system (e.g., encoders associated with vertical track motor 105, conveyor motors 121, and printer motors for positioning a print head), and cameras for identifying label or printing targets (e.g., camera 216). The data received from the various sensors may allow the processing unit to coordinate the movement of the stacked containers along the conveyor and the action of the applicator system such that the labels and/or directly printed information may be applied to the correct position on each of the containers in a grouped stacks of containers that is passed through the labeling system.

Embodiments of the processing unit may include an internal memory for storing various pre-loaded reference data describing one or more of the possible regular, irregular, nested, or other arrangements of the stacked containers (e.g., 2×2, 2×3, 2×4, 1×3+1×2, nested etc.). Such pre-loaded reference data may include the size of the individual containers ("size data"), the particular arrangement of the containers including the number of containers and the pattern in which they are arranged, such as regular arrangement of multiple stacks of containers or a nested arrangement ("grouping data"), and the location(s) on each individual container where a label and/or printed information should be applied to the container ("label position data"). The internal memory may be configured to store pre-loaded reference data for several different arrangements of containers that may vary in container size, container arrangement, and target label positions (i.e., different size data, grouping data, and label position data). The processing unit may include a look-up table for selecting the appropriate pre-loaded reference data for a grouping of container stacks loaded on the conveyor of the labeling system.

The processing unit may be capable of controlling the labeling system, including multiple applicator systems (e.g., applicator systems 100*a* and 100*b*), to automatically apply a label to or printing information directly on each individual container in multiple arrangements of containers based on the pre-loaded reference data that corresponds to the particular arrangement of the stacked containers (e.g., regular, irregular, nested, and other arrangements). Such a processing unit can use the position data regarding the group of stacked containers provided to it by position sensors (e.g., position sensors 122*a*, 122*b*, 122*c*, and 122*d*) and/or encoders (e.g., encoders associated with conveyor motors 121) and position data regarding the applicator systems (e.g., 110*a* and 110*b*) provided to it by position sensors (e.g., position sensors 215, cameras 216) and/or encoders (e.g., encoders associated with the vertical track motors 105, actuator arms 213, and encoders associated with printer heads 314 in direct printing embodiments) to coordinate (1) control of the conveyor motors to position the leading stack of containers in front of the applicator systems, (2) control of the vertical track motors to position the applicator systems at label targets of a first container in a stack, (3) to print and/or apply labels (e.g., apply pre-printed labels, print and apply labels, or directly print information onto the containers) on the target locations on the first containers, (4) sequentially move up or down (or from side to side) along the stacks of containers to each container in the stack and apply labels to each container at the label target locations, (5) move the grouped containers along the conveyor a pre-determined distance based on the pre-loaded reference data, (6) repeat steps 2-5 until the last containers are labeled, and (7) move the grouped stacks of containers along the conveyor away from the applicator systems.

Embodiments of labeling systems of the present invention may include a human interface device (e.g., a touchscreen; a combination of a keyboard, mouse, and a video monitor, etc.) for inputting information into the processing unit, such as selecting an appropriate pre-loaded reference data. Such a human interface device may allow a human operator to select pre-loaded reference data from a look-up table that can be viewed and accessed on a display. The human interface device may also allow for manually overriding the system to change various aspects of its operation. For example, and without limitation, an operator may opt out of an automatic container labeling protocol to place one or more additional label(s) on one or more containers, or to apply a general label on a pallet of containers. The operator may also customize information to be included on the label or to be printed directly on the containers through the interface device.

Figure 7A:
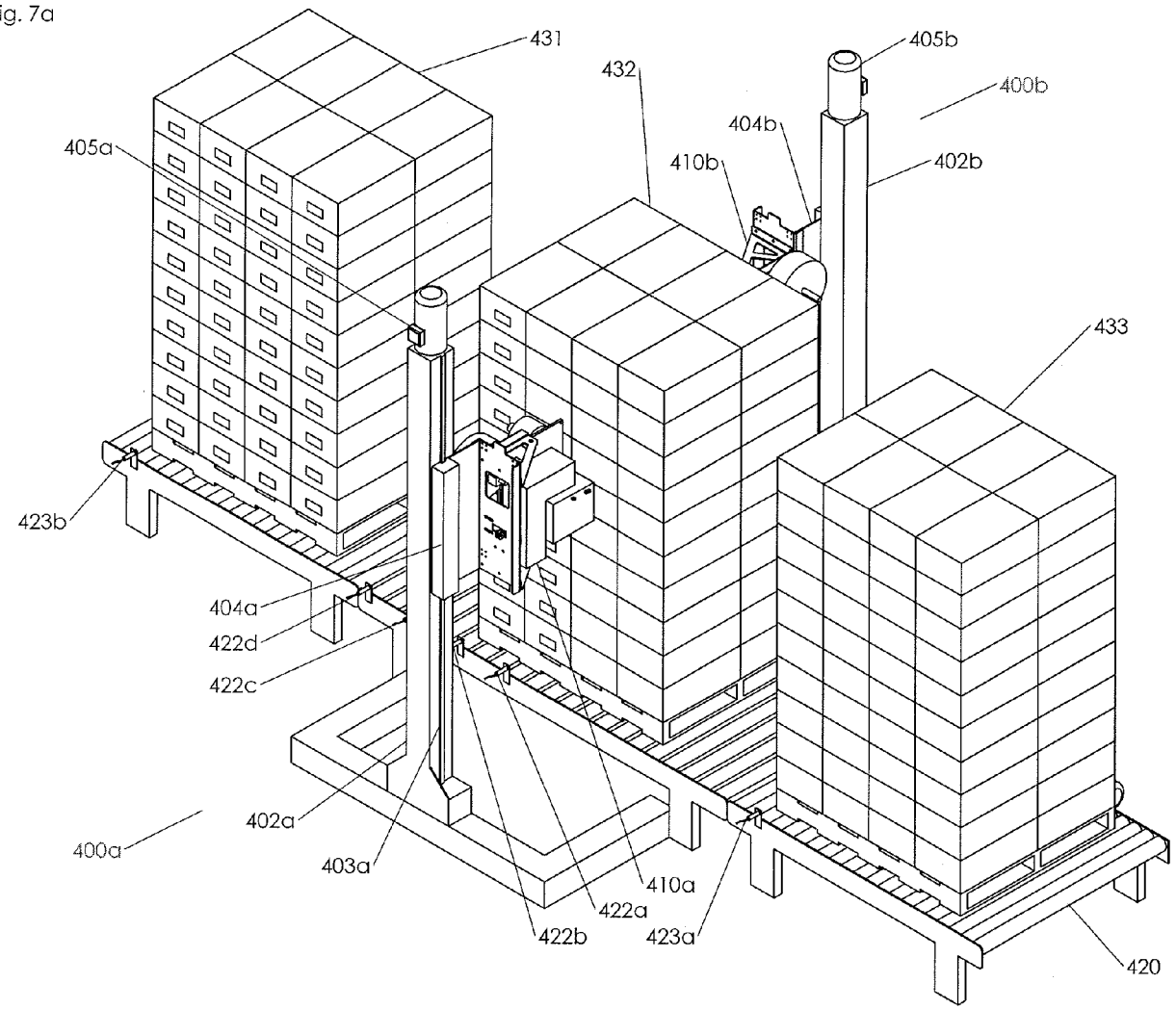
FIG. 7*a* is a perspective view of a label applicator system according an embodiment of the invention.
Figure 7B:
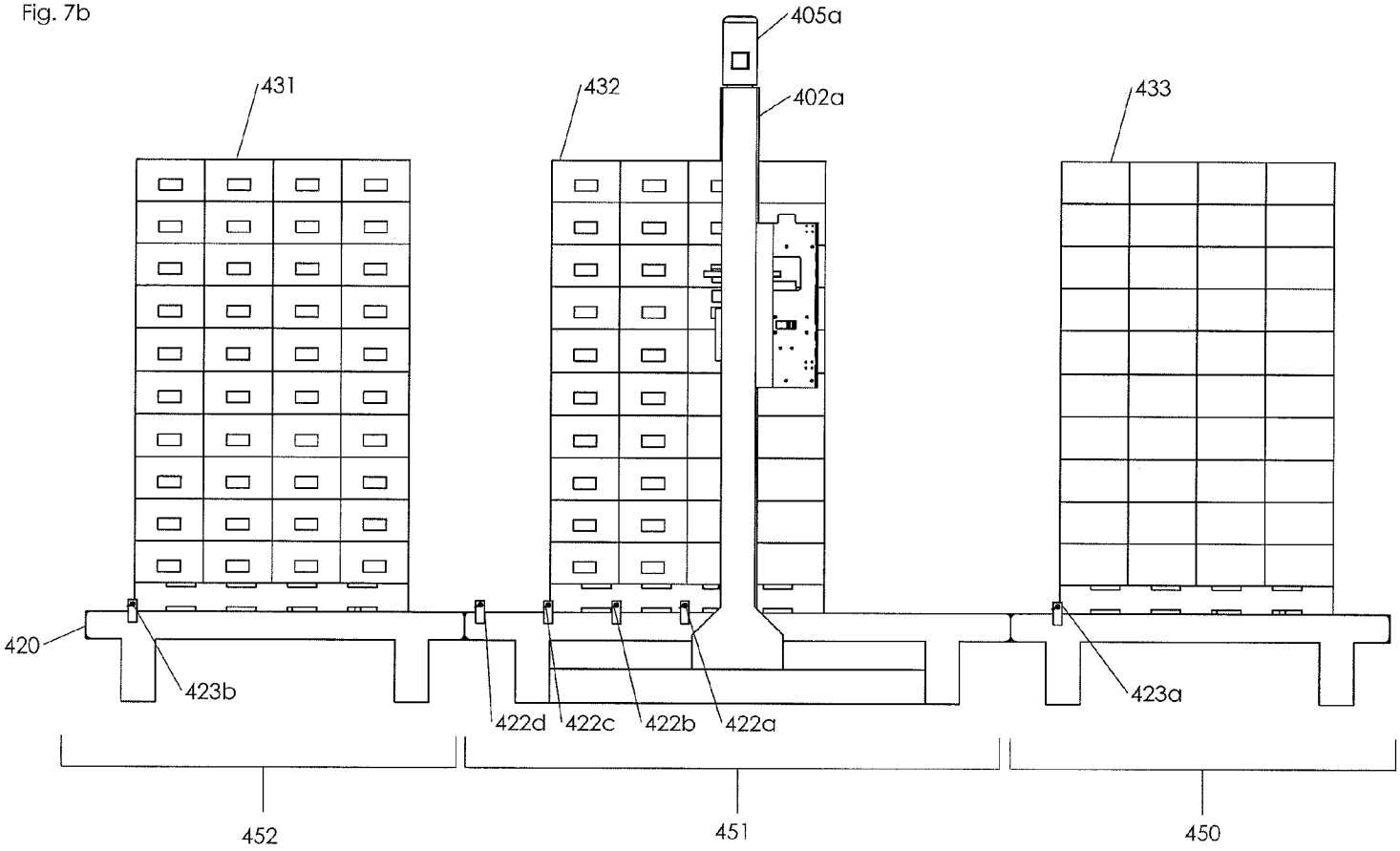
FIG. 7*b* is a frontal view of a label applicator system according an embodiment of the invention.
Figure 10:
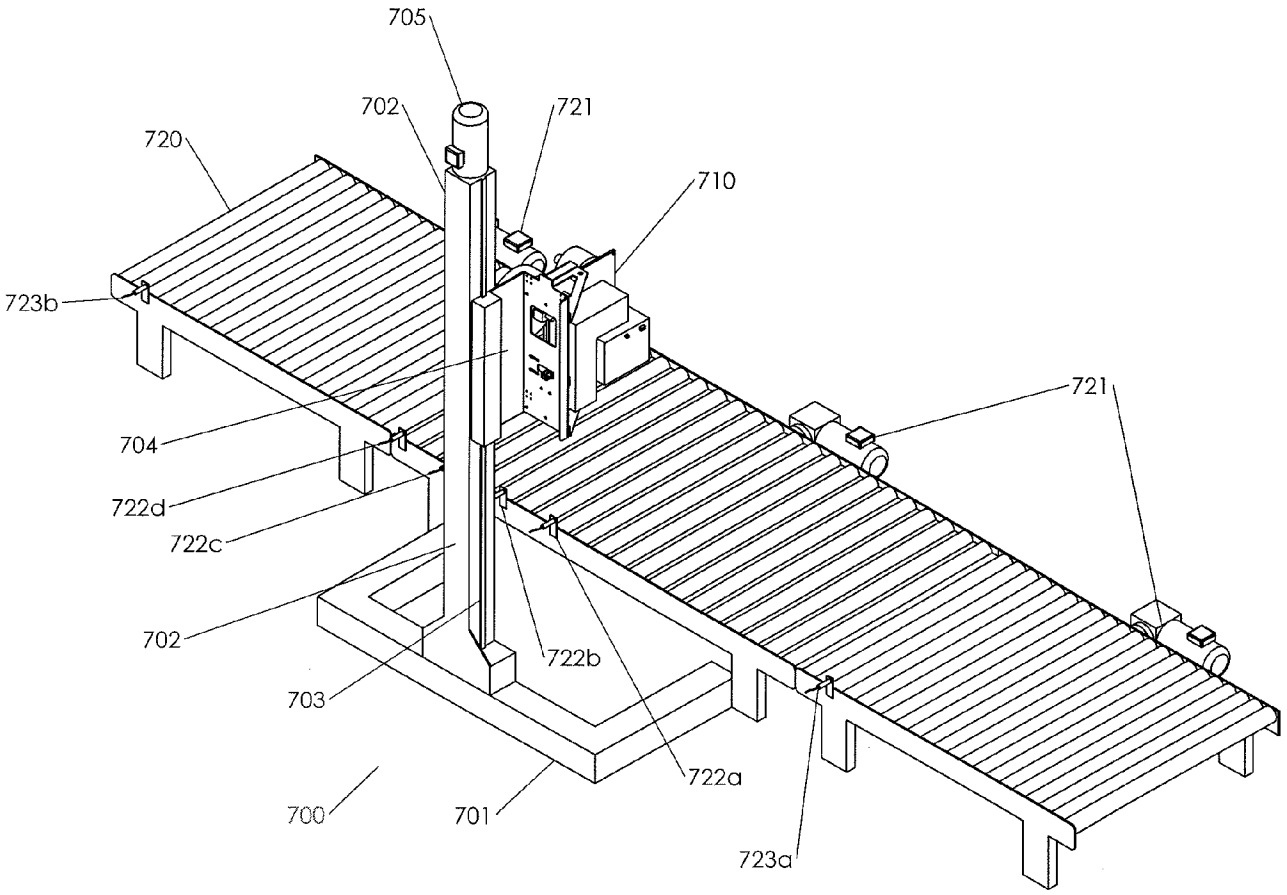
FIG. 10 is a perspective view of a label applicator system according an embodiment of the invention.

FIGS. 7*a* and 7*b* show snapshots of the operation of a labeling system according to an embodiment of the present invention (e.g., labeling system 100 shown in FIG. 4 or a single-sided system such as that shown in FIG. 10). In FIGS. 7*a* and 7*b*, three pallets 431, 432, and 433 each having a 2×4 regular arrangement of stacks of 10 containers thereon are present on conveyor 420. Pallet 431 is shown to have already passed between the applicator systems 400*a* and 400*b*, with each of the eighty containers on pallet 431 having received an individual label from the illustrated labeling systems. In the embodiment shown in FIGS. 7*a* and 7*b*, there are position sensors 422*a*, 442*b*, 422*c*, and 422*d* positioned at stopping points along the conveyor 420 near the applicator systems 400*a* and 400*b*. Each of the pallets has four side-by-side rows of two stacks of containers. In operation, as a front edge of a pallet arrives at the first position sensor 422*a*, the sensor 422*a* is tripped and sends a signal to the processing unit, which in response stops the conveyor motors to thereby hold the leading row of containers on the pallet aligned with the applicator systems 400*a* and 400*b*, such that one stack of containers of this row (e.g., a left stack) is situated in front of applicator system 400*a* and the other stack of containers of this row (e.g., the right stack) is situated in front of applicator system 400*b*. The applicator systems 400*a* and 400*b* may then begin applying labels (or directly printing) onto each container in the leading row of containers on the pallet.

In continued operation, after the leading row of containers has been labeled by the embodiment of FIGS. 7*a*-7*b*, the processing unit causes conveyor motors move the pallet until the second sensor 422*b* is triggered. At this point, the motor is stopped again, and the second row of container stacks on the pallet is now aligned with applicator systems 400*a* and 400*b*. The applicator systems 400*a* and 400*b* may then begin to print and/or apply labels onto each container in the stacks of the second row of containers on the pallet. It is to be appreciated that for purposes of efficiency, if labeling the first row of container stacks caused carriages 404*a* and 404*b* to move from top to bottom, then labeling of the next row may cause carriages 404*a* and 404*b* to move from bottom to top, which is illustrated in the center pallet of FIG. 7*a*. After the second row of containers has been labeled, the conveyor motors move the next row into position, labels are applied, and so on, until all rows have been labeled.

In some implementations, each of the applicator systems 400*a* and 400*b* may have a starting position that aligns the applicators 410*a* and 410*b* with a bottom container in the adjacent stack of containers. The vertical track motors 405*a* and 405*b* may then move the applicators vertically in a sequential manner such that each applicator moves to the next container as it completes the application of a label to the target location of the container with which it is engaged. The movement of the applicators is controlled by the processing unit. The processing unit controls the horizontal movement of the conveyor, the vertical movement of carriage, and the movement of the various components of the applicator based on the pre-loaded reference data that corresponds to the particular pallet it's labeling. Before a pallet is advanced to the applicators of the labeling system, a pre-loaded reference data may be selected in the processing unit. The pre-loaded reference data may be selected by an operator of the system (e.g., without limitation, through the human interface). After the pre-loaded reference data corresponding to the pallets is selected, the pallets are advanced along the conveyor. Once the position sensor 422*a* is tripped by a pallet, the processing unit may control the vertical track motor to move the applicator into a starting position, if it is not already in starting position (in other embodiments, the applicator may be moved into starting position immediately after finishing labeling a previous stack of containers). Subsequently, the processing unit may direct the motors within the applicator unit controlling the various components thereof to (1) feed a blank label into the printer, (2) print specific information on the label that may be unique to the individual container, (3) issue the printed label from the printer in a position in front of the label pad, (4) attach the label pad to the printed label, (5) extend the label pad outward toward the container by extension of the actuator arm to thereby attach the label to the target location on the container, (6) disengage the label pad from the container and the label (e.g., release vacuum pressure on the label), and (7) retract the actuator arm.

In many embodiments, once a label has been applied to a container, the processing unit directs the vertical track motor to move the carriage up a precise distance (e.g., equal to the height of one of the containers) based on the size data included in the pre-loaded reference data. The processing unit advances the applicator vertically a set number of times based on the number of containers indicated in the grouping data included in the pre-loaded reference data. When the applicator reaches the last (e.g. top or bottom) container in a stack, the processing unit may direct the vertical track motor to return the carriage and applicator to starting position. In some embodiments, the carriage is not returned to the starting position, but remains in place awaiting arrival of the next stack of containers, at which point labeling of the containers is accomplished in the opposite direction (e.g., from bottom to top). In some implementations, and without limitation, the grouping data of the pre-loaded reference data indicates the number of containers in a stack, and the number of stacks, and thus the grouping data prompts the processing unit to return the carriage to starting position once a label is applied to the last container. In other embodiments, the applicator may have a sensor thereon that is tripped when there is no container in front of the applicator, and thereby signals the processing unit that it has reached the end of the stack, and the processing unit, in turn, returns the carriage to starting position.

Referring to FIGS. 7*a*7*b*, after the applicators finish applying labels to the first row of containers, the processing unit directs the conveyor motors to activate and move the pallet(s) forward along the conveyor. When the leading edge of the pallet reaches position sensor 422*b*, the position sensor 422*b* is tripped and sends a signal to the processing unit, which in turn sends a signal to the conveyor motors to stop and hold the pallets in their current positions, placing the second row of container stacks in front of the applicators. FIG. 7*a* shows this stage of the process, where the leading edge of pallet 432 is positioned at the second position sensor 422*b*, and the second row of container stacks on pallet 432 is in front of applicators 410*a* and 410*b*. The processing unit then directs the applicator systems 400*a* and 400*b* to sequentially apply labels to each individual container as described above. Position sensors 422*c* and 422*d* are present to provide stopping points for the pallet to facilitate application of labels to the containers in the third and fourth rows of container stacks, respectively. FIG. 7*b* shows the applicator 410*a* positioned in front of the third row of container stacks on pallet 432, and applying labels to the containers in the stack. Once the last row of container stacks is labeled, the pallet is moved out of the labeling station and down the conveyor 420.

The conveyors (e.g., conveyor 120, 420, etc.) of the present invention may be segmented, having separate motors driving different portions of the conveyor (as shown in FIG. 4, which includes multiple motors 121). For example, and without limitation, FIG. 7*b* shows three separate segments 450, 451, and 452 of conveyor 420, each of which is driven by a separate motor(s). In some implementations, additional sensors may be present along the conveyor for additional stopping points for the pallets for each of these segments. As shown in FIG. 7*b*, there may be additional position sensors 423*a* and 423*b*, which, when tripped, signal the processing unit to stop the operation of motors driving sections 450 and 452, respectively.

In other implementations, and without limitation, the conveyors may be driven by servo motors or other motors (e.g. with encoders) that are capable of precise position control without the need for additional sensors (e.g., sensors 422*a,b,c,d* and sensors 423*a,b*). In such implementations, the motors associated with the conveyors may provide precise data regarding the rotational movement of the motor, allowing the processing unit to calculate the position of each pallet along a conveyor with precision. In such implementations, there may be a position sensor on the applicator system that signals to the processing unit when a front edge of a pallet has arrived at the labeling station. No further sensors may be required to control the movement of the pallet, since the servo motors of the conveyor provide precise position data and facilitate precise control of the position of the pallets.

Figure 8:
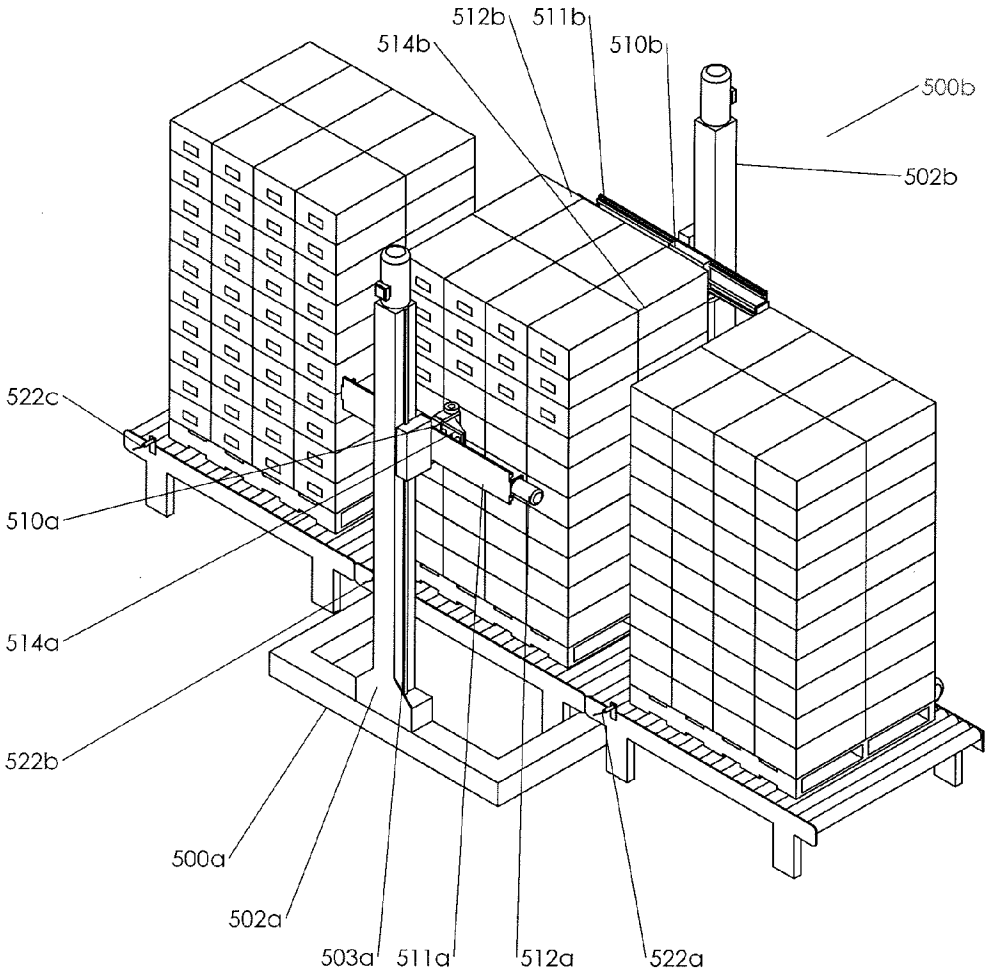
FIG. 8 is a perspective view of a label applicator system according an embodiment of the invention.

As discussed herein, in some embodiments, the labeling system of the present invention may include a printer head that may print directly onto surfaces of containers. As shown in FIG. 8, the labeling system of the present invention may include applicator systems 500*a* and 500*b*, each of which includes a printer without a label applicator (e.g., a printer system), allowing the identification information for the containers to be directly printed on the containers. In the interest of simplicity and brevity, the components and elements of the applicator systems 500*a* and 500*b* will be described collectively without reference to the "a" and "b" designations present in FIG. 8. The applicator 510 may include a printer track 511, a printer head 514 mounted on the printer track 511 via a printer carriage, a printer motor 512 for moving the printer head 514 along the printer track 511, and actuator arm (not shown, see FIGS. 6a-6d as an example) attached to the printer track 511 configured to extend the printer head 514 outward toward the containers on the pallet 532, allowing the printer head 514 to print directly on target positions on each of the containers.

In such embodiments, without limitation, the pallet may be parked at the applicator station at a single position, and the printer head 514 can reach each container in the stack without the need to advance the pallet through the applicator station in a sequential (e.g., row-by-row) manner. The printer track 511 may be sufficiently wide to reach each container on the adjacent side of the pallet 532. The processing unit may be in electronic communication with the printer motor 512, allowing the processing unit to direct the horizontal position of the printer head 514 according to the pre-loaded reference data corresponding to pallet 532. Additionally, in implementations where the pallets need be parked at only a single position in front of the applicators, fewer position sensors may be needed along the conveyor 520. For example, and without limitation, FIG. 8 shows a conveyor having only a single position sensor 522b in the labeling station. Sensor 522b may be positioned at a such that when a leading edge of the pallet trips the sensor and signals the conveyor 520 to stop, the pallet is in a position that allows the printer head 514 to reach each stack of containers on the adjacent side of the pallet. The sensors 522a and 522c may be positioned at stopping points on other segments of the conveyor 520. In other implementations, and without limitation, the labeling system may include an applicator that includes a printer system like the one shown in FIG. 8, but where the conveyor is motorized by servo motors or other motors that are capable of precisely controlling motion without the need for additional sensors. In still other implementations, and without limitation, the applicator may include a printer system, and the conveyor may have multiple position sensors in the labeling station to facilitate a stepwise, row-by-row movement of the pallet through the labeling station as described above in reference to embodiments like that shown in FIGS. 7a-7b.

Figure 9:
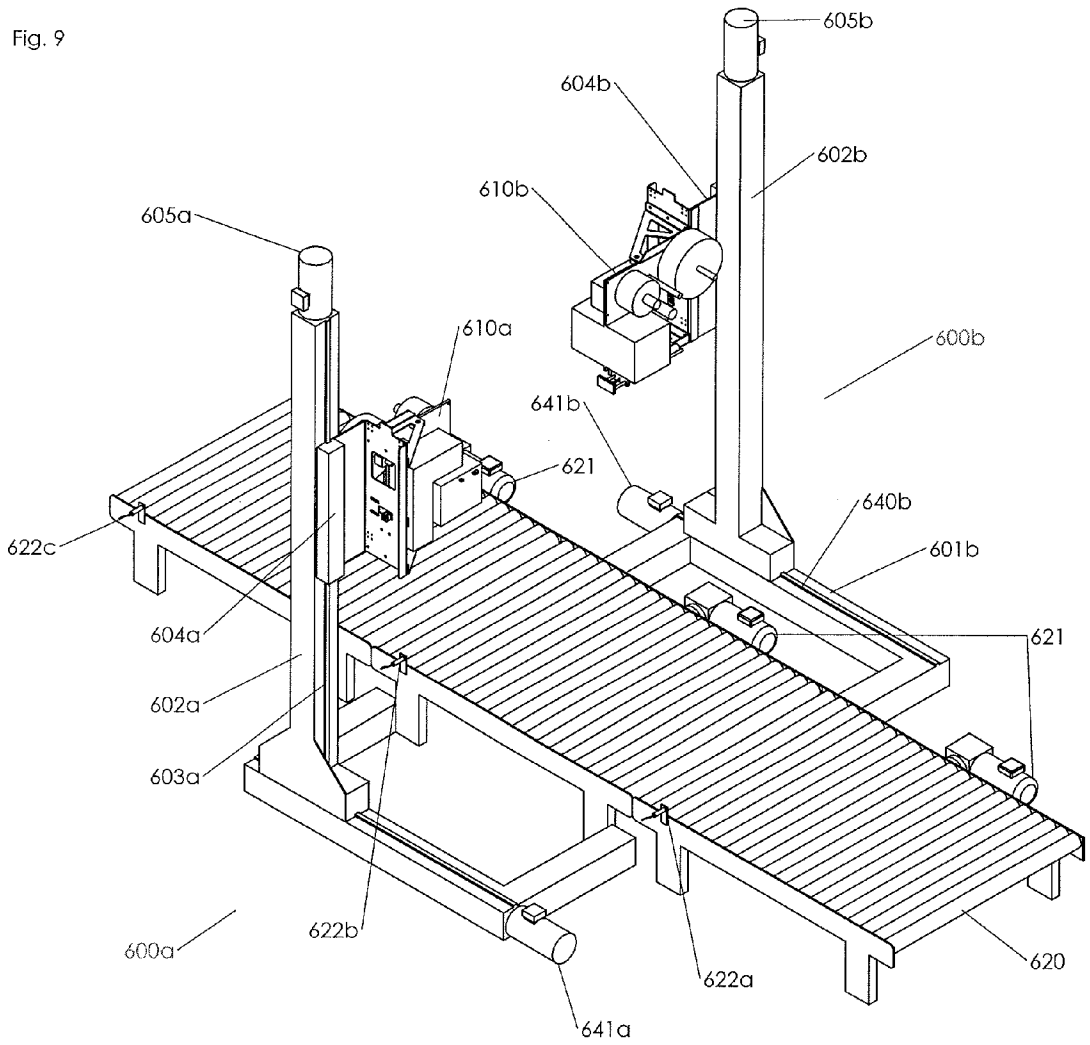
FIG. 9 is a perspective view of a label applicator system according an embodiment of the invention.

FIG. 9 shows an alternative embodiment of the applicator system. The exemplary embodiment of a labeling system according to invention shown in FIG. 9 shows a system that includes much of the same features that are included in the exemplary embodiment of FIG. 4. In the interest of simplicity and brevity, the components and elements of the applicator systems 600a and 600b will be described collectively without reference to the "a" and "b" designations present in FIG. 9. Each of the applicator systems 600a and 600b include a support frame 601 having a vertical support member 602, a vertical track 603 engaged with a vertical track motor 605, and a carriage 604 supporting an applicator 610, which may include features configured to apply (and optionally print) labels to or directly print on containers in various positions. However, in such embodiments, the horizontal positioning of the applicator system is not accomplished by movement of the conveyor 620. Rather, the support frame 601 includes a horizontal track 640 with which vertical support member 602 is engaged. The horizontal track 640 has a conveying mechanism that includes a drive element (e.g., a chain, a belt, a ball screw, or other flexible or positive drive element) that is engaged with a horizontal track motor 641 for driving the movement of the drive element. The horizontal track motor 641 may be various kinds of motors such as an AC motor, a servo motor, etc.). The horizontal track 640 may be sufficiently wide to position the vertical support member 602 and the applicator system 610 in front of each container stack in a pallet parked at the labeling station without the need to advance the pallet in the labeling station.

In the illustrated exemplary embodiment of FIG. 9, the processing unit may be in electronic communication with the horizontal track motor 641, allowing the processing unit to direct the horizontal position of the vertical support member 602 along the horizontal track 640 according to the pre-loaded reference data corresponding to the pallet or grouped stacks of containers to be labeled. Additionally, in such embodiments, fewer position sensors may be needed along the conveyor 620 because the pallet need be parked at only a single position in front of the applicators 610a and 610b. For example, and without limitation, FIG. 9 shows a conveyor having only a single position sensor 622b in the applicator station. Sensor 622b may be positioned at a such that when a leading edge of the pallet trips the sensor and signals the conveyor 620 to stop, the pallet is in a position that allows the applicators 610a and 610b to reach each stack of containers on the side of the pallet adjacent thereto. The sensors 622a and 622c may be positioned at stopping points on other segments of the conveyor 620. In other implementations, and without limitation, the labeling system may include an applicator that includes a printer system, but without the need for a printer track. In such implementations, printer heads may be mounted on actuator arms that are directly on the carriages (e.g., carriages 604a and 604b). The horizontal movement of the vertical support members 602a and 602b under the control of the processing unit may be sufficiently precisely controlled to directly print information on target locations of each of the containers on a pallet.

The present invention also encompasses embodiments of single-sided labeling stations (having one applicator system) that can be used in a number of applications. For example, and without limitation, single-sided applicator systems may be used for grouped stacks of containers that include a single lateral row of containers (e.g., 1×2, 1×3, 1×4, etc.), or to provide labeling on containers on only one side of a group of containers. FIG. 10 shows an exemplary labeling system 700 having a single applicator system.

The components of the exemplary single-side applicator system shown in FIG. 10 are the same or similar to the components of the applicator system 100 of FIG. 4. The labeling system 700 works in much the same way as the labeling system 100 in FIG. 4, but is limited to the capability of labeling or printing on a single side of the pallet or group of containers at a time. In particular, the exemplary applicator system illustrated in FIG. 10 includes a support frame 701 having a vertical support member 702. The support frame 701 is positioned in proximity to a horizontal conveyor 720, upon which a grouping of container stacks may be placed. The vertical support member 702 has a vertical track 703, which guides a conveying mechanism that includes a drive element (e.g., a chain, a belt, a ball screw, piston, or other flexible or positive drive element) that is engaged with a motor 705 for driving the movement of the drive element 706. The vertical track motor 705 may be various kinds of motors (such as an AC motor, a servo motor, etc.). A carriage 704 is connected to the drive element and is guided by vertical track 703. The carriage 704 supports an applicator 710, which may include features configured to print and/or apply labels (e.g., adhesive labels) to containers in various positions, and/or print information directly on an exterior surface of a container.

As with other embodiments of the invention, in some implementations, it is preferred that the vertical track motor 705 be a servo motor having an encoder, which allows precise control of the movement of the conveying system and precise positioning of the carriage 704 and the applicator system 710. The use of a servo motor to drive the conveying mechanism 706 may allow for more reliable placement of labels or printed information on the containers. The horizontal conveyor 720 of the embodiment of FIG. 10 may be motorized and enabled to advance arrangement of containers along the conveyor 720 toward the applicator system 700. The conveyor may have one or more motors 721 driving the conveyor system, which is shown to be a roller conveyor in FIG. 10, but may include another kind of conveyor in other implementations (e.g., a belt conveyor). In some implementations, and without limitation, the conveyor motors 721 may be basic AC motors. In such implementations, there may be multiple position sensors 722*a*, 722*b*, 722*c*, and 722*d*. The position sensors may be any of various kinds of position sensors, such as simple photosensors. The position sensors 722*a*, 722*b*, 722*c*, and 722*d* may be positioned along the conveyor 720 at various stopping points for the grouped stacks of containers along the conveyor 720. These stopping points are determined based on a particular arrangement of the containers (e.g., regular, irregular, nested, or other arrangement). For example, and without limitation, the grouped stacks of containers may include a regular arrangement of containers that is two stacks wide and two or more stacks long (e.g., 2×2, 2×3, and other regular arrangements) on the conveyor 720. In such an arrangement, the position sensor 722*a* may be at a first stopping point for the grouped stacks of container, positioning the first stack of containers adjacent to applicator system 710; the position sensor 722*b* may be at a second stopping point, positioning the second stack of containers adjacent to the applicator 710; the position sensor 722*c* may be at a third stopping point, positioning the third stack of containers adjacent to the applicator system 710; and the position sensor 722*d* may be at a fourth stopping point, positioning the fourth stack of containers adjacent to the applicator system 710. It is to be appreciated that more or fewer sensors 722 may be provided in other embodiments to allow for positioning more or fewer stacks of containers. It is also to be appreciated that the positions of sensors 722 may be uniform or non-uniform, depending on the position(s) of the containers (often dictated by container size/width) expected to be in the stacks on the conveyor. It is to be appreciated that the positions of the sensors may be automatically or manually adjustable to compensate for different container arrangements that may be sent through the same system. It is to be further appreciated that in some embodiments of single-sided labeling systems, the conveyor motors 721 may be servo motors allowing precise control over the movement and position of a group of stacked containers along the conveyor. In such implementations, the position(s) of exemplary sensors 722*a*, 722*b*, 722*c*, and 722*d* may not be necessary.

The applicator 710 may include a label printer and applicator like that described above in reference to FIG. 5. Alternatively, the applicator 710 may include a printer capable of directly printing on containers, like the printer described above in reference to FIGS. 6*a*-6*d*. All of the motors (e.g., motors 705, 721, and the motors included in the applicator 710) and the encoders that may be associated with the motors, as well as all of the sensors (e.g., sensors 722*a*, 722*b*, 722*c*, and 722*d*, and the sensors included in the applicator 710), may be in electronic communication with a processing unit as discussed above in reference to other figures. The processing unit may be a programmable logic controller or other computing device having software adapted to control the various elements of the labeling system. The data received from the various sensors may allow the processing unit to coordinate the movement of the stacked containers along the conveyor and the action of the applicator system according to a pre-loaded reference data such that the labels and/or directly printed information may be applied to the correct position on each of the containers.

The operation of the single-sided embodiment 700 of FIG. 10 is similar to that of embodiment 100 of FIG. 4, illustrated in FIGS. 7*a*-7*b*. As a front edge of a pallet arrives at the first position sensor 722*a*, the sensor 722*a* is triggered and sends a signal to a processing unit, which stops the conveyor motors thereby stopping lateral movement of the pallet. This causes a leading stack of containers on the pallet to be aligned with the applicator system 700, such that a stack of containers is situated in front of applicator system 700. The applicator system 700 then applies labels (or directly printing) onto each container in the aligned stack of containers on the pallet. In continued operation, after the leading stack of containers has been labeled, the processing unit causes conveyor motors move the pallet until the second sensor 722*b* is triggered. At this point, the motor is stopped again, and a second stack of containers on the pallet is now aligned with applicator system 700. The applicator system 700 then begin applying labels (or directly printing) onto each container in the second stack of containers on the pallet. It is to be appreciated that for purposes of efficiency, if labeling the first row of containers caused carriage 704 to move from top to bottom, then labeling of the next row may cause carriage 704 to move from bottom to top (such as the illustration of the center pallet of FIG. 7*a*). After the second stack of containers has been labeled, the conveyor motors move the next stack into position, labels are applied, and so on, until one side of all stacks on the pallet have been labeled.

Figure 11:
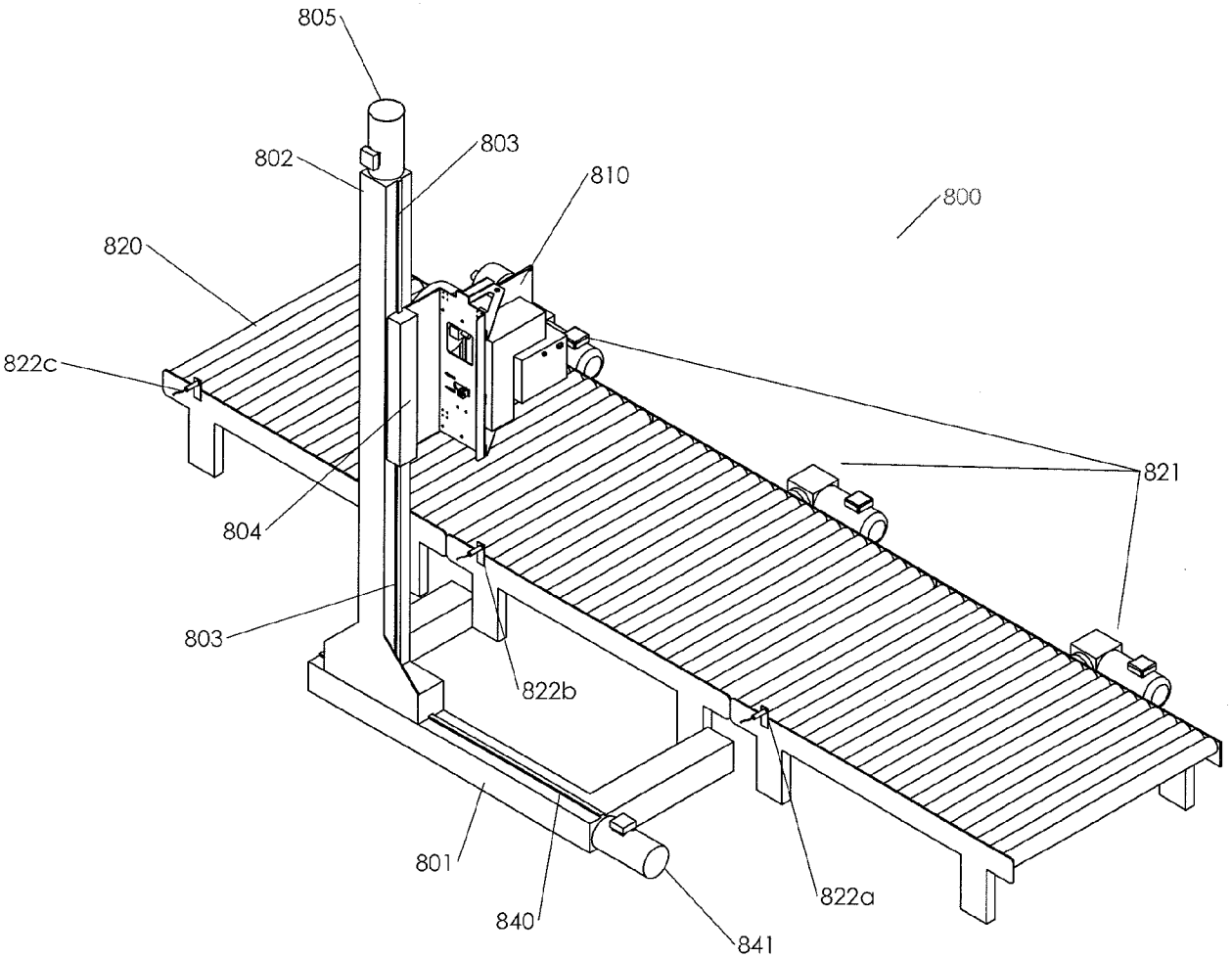
FIG. 11 is a perspective view of a label applicator system according an embodiment of the invention.

In some embodiments, and without limitation, a single-sided labeling system may include both horizontal and vertical tracks for positioning an applicator. FIG. 11 shows an exemplary labeling system 800 that includes much of the same features that are included in the exemplary embodiment of FIG. 9. In the interest of simplicity and brevity, the components and elements of the labeling system 800 will not be fully described. The components and elements of labeling system 800 correspond to elements and components of FIG. 9 that have similar reference numbers (e.g., reference number 602 in FIG. 9 corresponds to reference number 802 in FIG. 11 for the vertical support member, etc.). The applicator system 800 includes a support frame 801 having a vertical support member 802, a vertical track 803 engaged with a vertical track motor 805, and a carriage 804 supporting an applicator 810, which may include features configured to print and apply labels to or directly print on containers in various positions. In such embodiments, the horizontal positioning of the applicator system may be accomplished by movement of the vertical support member 802. A horizontal track motor 841 may be configured to drive the movement of vertical support member 802 along horizontal track 840 under the control of the processing unit.

Figure 12:
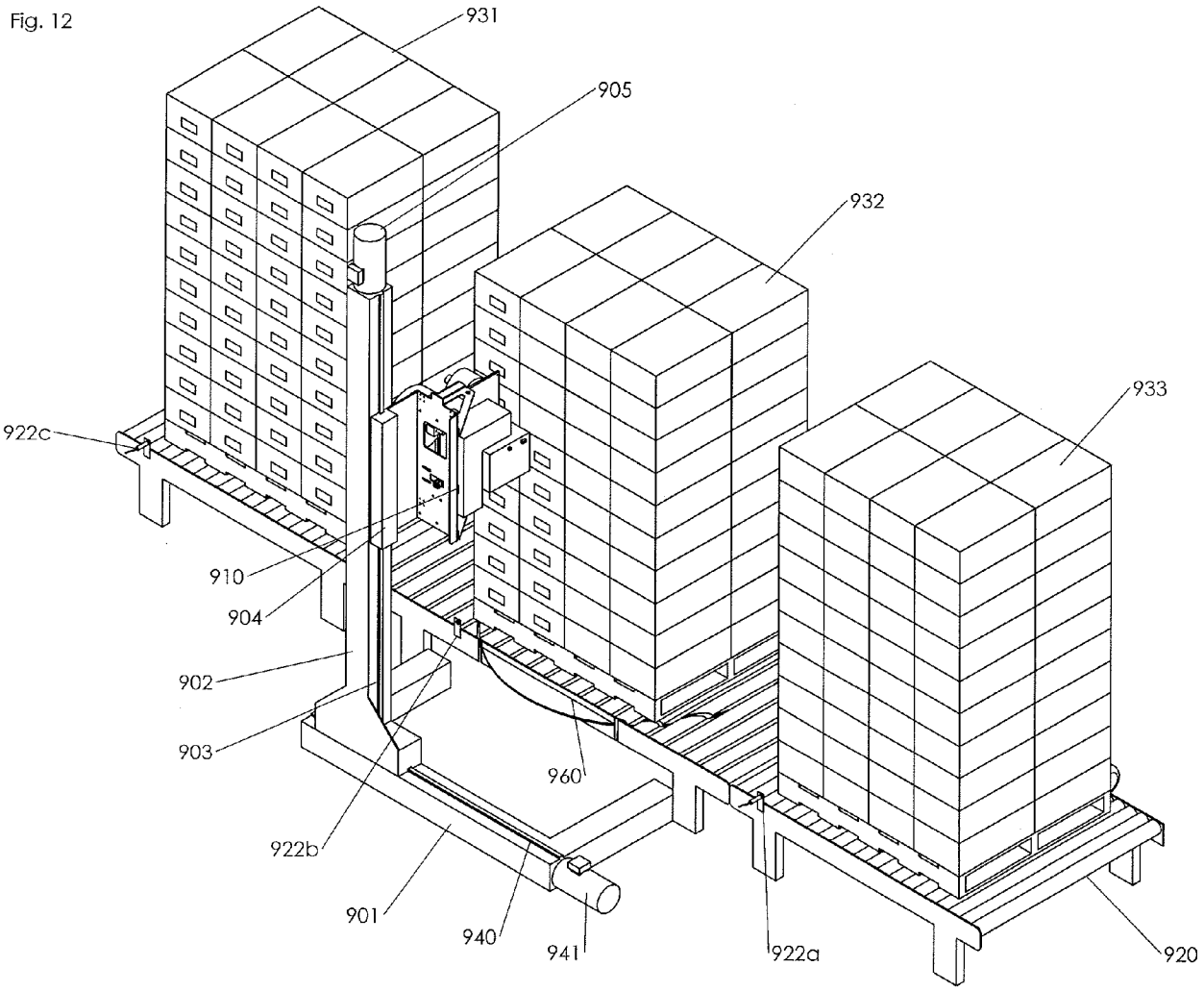
FIG. 12 is a perspective view of a label applicator system according an embodiment of the invention.

FIG. 12 shows a further variation of a single-sided labeling system. The exemplary labeling system 900 includes a turn table 960 positioned at the labeling station, and an optional conveyor 920. The turn table 960 may enable a single-sided labeling system to label each container in a regular arrangement that includes 2 or more lateral rows of stacks (e.g., configurations such as 2×2, 2×3, 2×4, 3×3, 3×4, etc.), an irregular arrangement (e.g., 1×3+1×2, 2×3+1×2, etc.), a nested arrangement, or other arrangement. The pallet 932 (or group of container stacks) may be moved adjacent to the labeling system on a turn table 960. This may be accomplished, as illustrated, using a conveyor 920. The applicator system 901 may then proceed with labeling each container on the adjacent side of the pallet 932 according to a pre-loaded reference data stored in an internal memory of the processing unit and corresponding to the arrangement of containers on pallet 932. Once the applicator system 901 has completed labeling each of the containers on the first side, the turn table may be rotated 90° or 180° in either rotational direction to place a second side in front of the applicator system 910. Thus, the turn table 960 may enable the single applicator system 910 to access each container on the pallet 932 and apply labels to each of the containers. The turn table 960 may be in communication with an AC motor, servo motor, or other motor type capable of reliably and precisely rotating the turn table in specific angular distances. In implementations in which the motor is not a servo motor, there may additionally be encoder associated with the motor. The motor connected to the turn table 960 (and the associated encoder) may be in electronic communication with the processing unit of the labeling system.

In use, when the processing unit of the embodiment of FIG. 12 has finished directing the applicator system to apply labels or printing to the containers on one side of a pallet based on the pre-loaded reference data corresponding to the pattern of containers on the pallet, the processing unit may direct the motor associated with the turn table 960 to rotate the turn table a specific rotational distance to thereby provide the applicator system 910 access to another side of the pallet. In such embodiments, the pre-loaded reference data may include instructions on how to rotate the turn table 960. For example, and without limitation, in cases where a pallet has two lateral rows of container stacks (e.g., configurations such as 2×2, 2×3, and 2×4), the pre-loaded reference data may include instructions to rotate the turn table 960 180° after the containers on the first side of the pallet are labeled. The pre-loaded reference data may also include instructions to move the pallet along the conveyor away from the labeling station after the containers on the opposite side of the pallet are labeled. In other cases, more than two sides of the pallet will need to be placed in front of the applicator system (e.g., for an irregular arrangement of containers). In such cases, the pre-loaded reference data may include instructions to rotate the turn table 960 90° after the containers of the first side are labeled, and then to rotate the turn table 960 90° again after the containers of the second side are labeled to thereby provide the applicator system with access to a third side of the pallet.

The present invention encompasses further embodiments of the single-sided labeling system, include single-sided labeling systems that are stationary and that do not include a conveyor system. In such embodiments, the applicator system may have the capability to move the applicator in two dimensions (e.g., in an x-y pattern), such that each individual container that is exposed on one side of a pallet or grouping of containers can be labeled without the need to adjust a position of the pallet or arrangement of containers. In such embodiments, multiple sides of the pallet or grouping of containers may be positioned in front of the applicators system in the labeling station (e.g., by pallet jack or other separate conveying device) to allow other sides of the container and/or to allow the applicator to access other containers that are not exposed on the initially-labeled side of the pallet or grouping of containers.

The present invention encompasses still further variations of the single-sided labeling system, including embodiments in which the applicator system is mobile (e.g., it sits on a cart). The cart may also optionally carry the human interface and the processing unit. In such embodiments, the conveyor system is unnecessary. The cart can be wheeled up to a palleted arrangement of containers or an otherwise grouped set of container stacks and apply labels and/or printing to a side of the containers. This embodiment allows the applicator system to be placed next to multiple sides of the pallet, enabling the labeling system to apply labels to each container in various arrangements of containers (e.g., regular arrangement of 2×2, 2×3, 2×4, 3×3, 3×4, irregular arrangements, nested arrangements, etc.). Various other embodiments of a single-sided labeling system are encompassed within the scope of the present invention as well.

The present invention encompasses further embodiments of a labeling system that include a different support and frame system from the embodiments discussed above. In some embodiments, the labeling system may include a four-sided frame system that may sit over a conveyor, and a movable carriage mounted in the frame system that is configured to move along a vertical path above the conveyor system at the labeling station. The labeling systems that include a four-sided frame system may have many of the same or similar elements and components as the embodiments discussed above, and may incorporate those elements and components discussed above that are compatible with the four-sided frame system.

Figure 13A:
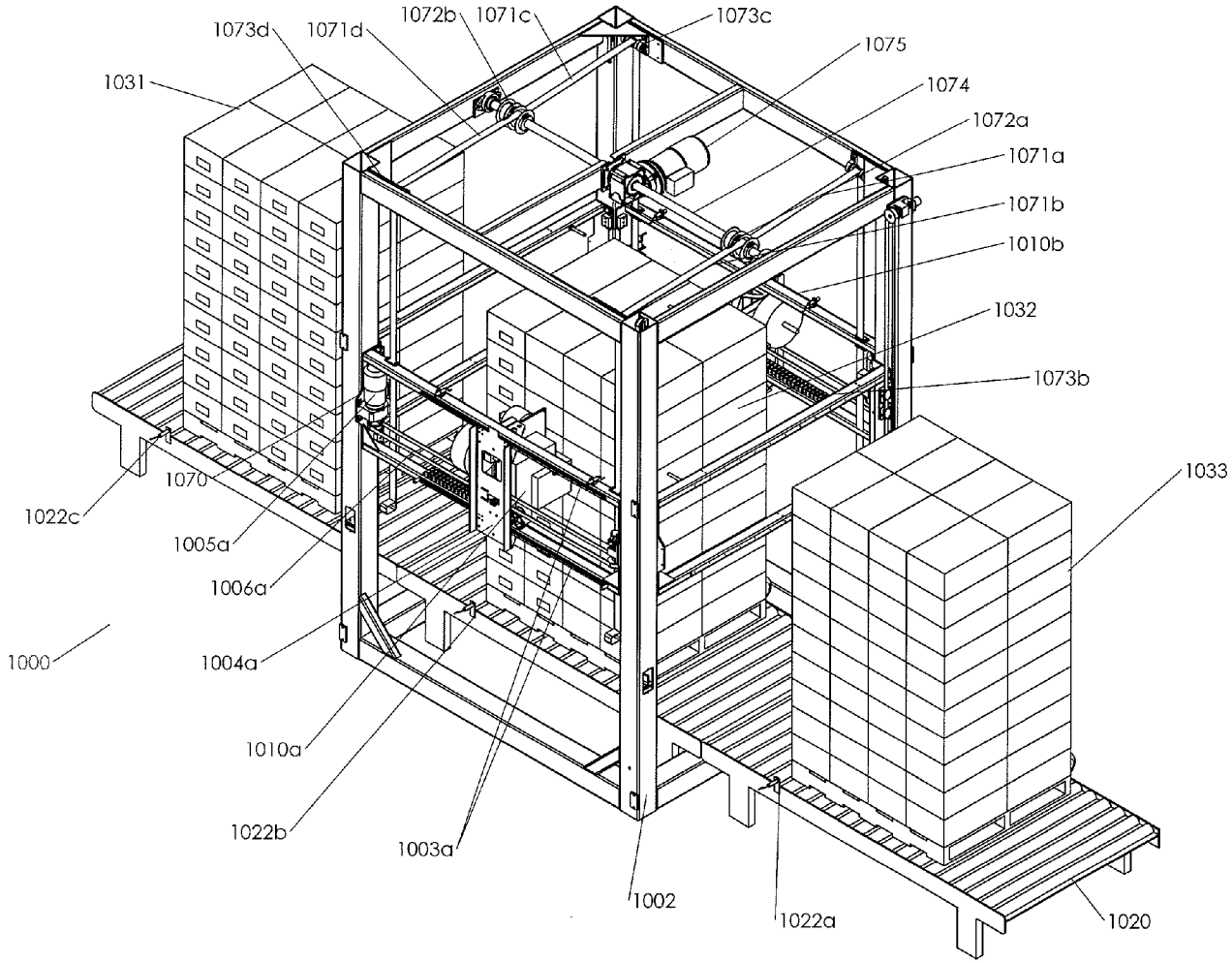
FIG. 13*a* is a perspective view of a label applicator system according an embodiment of the invention.

FIG. 13*a* shows an exemplary labeling system 1000 having a four-sided frame 1002 that is positioned over conveyor 1020 at a labeling station. The four-sided frame may have vertical tracks running along the vertical corner posts thereof to accommodate the movement of a lift carriage 1070 mounted within the frame 1002. The lift carriage 1070 may be four-sided as well, and the corners thereof may be engaged with the vertical tracks within the vertical corner posts of the frame 1002. The lift carriage 1070 may be moved up and down along the vertical tracks by a lift system that includes lift elements 1071*a*, 1071*b*, 1071*c*, and 1071*d* (e.g., chains, belts, or other flexible, but non-stretchable device) attached to the lift carriage 1070, spools 1072*a*, 1072*b*, 1072*c*, and 1072*d*, axle 1074, and lift motor 1075 for driving the axle 1074. The lift system may be operable to move the lift carriage up and down with precise position control. The lift motor 1075 may be an AC motor, servo motor, or other motor type capable of reliably and precisely lifting or lowering the lift carriage 1070 in precise vertical distances. In implementations in which the lift motor 1075 is not a servo motor, there may additionally be encoder associated with the motor. The lift motor 1075 (and, optionally, one or more encoders associated with lift motor 1075) may be in electronic communication with a processing unit configured to control the operation of the lift motor 1075 and thereby control the movement of the lift carriage 1070. In alternative embodiments, the lift system may include multiple lift motors mounted on the sides of frame 1002 above or below the sides of the lift carriage 1070. In such embodiments, a drive element (e.g., a chain, a belt, a ball screw, or other flexible or positive drive element) may connect each lift motor to the lift carriage in a vertical relationship. In implementations that include multiple lift motors, the processing unit may be configured to coordinate the operation of the motors so that motors to do not get out of sync and consequently apply torsion or torquing forces to the lift carriage 1070.

The exemplary lift motor 1075 may be operable to spin axle 1074 in both rotational directions, allowing the lift motor 1075 to both lower and raise the lift carriage 1070.

Spools 1072*a*, 1072*b*, 1072*c*, and 1072*d* for collecting and letting out the lift belts 1071*a*, 1071*b*, 1071*c*, and 1071*d* may be fixedly mounted on the axle 1074, so that the spools rotate the same rotational distance and direction as the axle 1074. The lift belts 1071*a*, 1071*b*, 1071*c*, and 1071*d* may be fixedly attached to the spools 1072*a*, 1072*b*, 1072*c*, and 1072*d*, respectively. The lift belts 1071*a*, 1071*b*, 1071*c*, and 1071*d* may be respectively routed over pulleys 1073*a*, 1073*b*, 1073*c*, and 1073*d* (pulleys 1073*c* and 1073*d* are obscured behind the frame 1002 in FIG. 13*a*), allowing the lift belts to have vertical paths down to the lift carriage 1070.

The exemplary lift carriage may have four sides, each of which may be configured to have an applicator system mounted thereon. In the interest of simplicity and brevity, some of the components and elements of the applicator systems 1001*a* and 1001*b* will be described collectively without reference to the "a" and "b" designations present in the figures. In exemplary embodiment of FIG. 13*a*, the lift carriage 1070 is outfitted with two applicator systems 1001*a* and 1001*b*, positioned on opposing sides of the lift carriage 1070. Each of the applicator systems 1001*a* and 1001*b* includes a horizontal track 1003 and an applicator carriage 1004 mounted thereon (the applicator carriage 1004 is movably connected to the horizontal track 1003). A conveying mechanism may be coupled to the applicator carriage 1004 and a horizontal track motor 1005. The conveying mechanism may include a drive element 1006 such as a chain, a belt, a ball screw, or other flexible or positive drive element driven by the horizontal track motor 1005 connected thereto. The applicator carriage 1004 may be moved horizontally along the horizontal track 1003, allowing it to be positioned in front of multiple container stacks in group of container stacks (e.g., palleted container stacks).

The exemplary applicator system 1010 mounted on the applicator carriage 1004 may include a label spool and applicator like that described above in reference to FIG. 5. The label spool may be loaded with pre-printed labels, requiring no information to be added to the label. In some implementations, the applicator system may also include a printer for printing information on the labels. Alternatively, the applicator system 1010 may include a printer capable of directly printing on containers, like the printer described above in reference to FIGS. 3*a*-3*d*.

As mentioned above, the exemplary labeling system 1000 may also include a processing unit that may be in electronic connection with the various other components and elements of the labeling system. Such a processing unit may be a programmable logic controller or other computing device having software adapted to control the various elements of the labeling system. More specifically, the processing unit may be in electronic communication with the motors driving the conveyor 1020 (e.g., motors 1021), the horizontal track motors 1005*a* and 1005*b*, and the motors within the applicator systems 1010*a* and 1010*b* (e.g., an actuator arm, stepper motors or other types of motors driving the printer, and/or label feeder). The processing unit may also be in electronic communication with various sensors within the labeling system 1000, including position sensors (e.g., position sensors 1022*a*, 1022*b*, and 1022*c*), encoders associated with various motors within the labeling system (e.g., encoders associated with horizontal track motors 1005*a* and 1005*b*, conveyor motors 1021, and lift motor 1075), and cameras for identifying label or printing targets. The data received from the various sensors may allow the processing unit to coordinate the movement of the pallets 1031, 1032, and 1033 along the conveyor 1020, the vertical motion of the lift carriage 1070, and the horizontal motion of the applicator systems 1010*a* and 1010*b*.

As discussed above, an exemplary processing unit may include an internal memory for storing various pre-loaded reference data describing one or more of the possible arrangements of container stacks (e.g., regular arrangements, irregular arrangements, nested arrangements, etc.) that are loaded on a pallet or are otherwise grouped together. The internal memory may be configured to store pre-loaded reference data for several different arrangements of containers that may vary in container size, container arrangement, and target label positions (i.e., different size data, grouping data, and label position data). The processing unit may include a look-up table for selecting the appropriate pre-loaded reference data for an arrangement of containers loaded on the conveyor of the labeling system. The pre-loaded reference data allows the processing unit to operate the various motors in the labeling system 1000 to direct the applicator systems 1010*a* and 1010*b* to automatically apply labels and/or directly print information to the correct position on each of the containers in the arrangement that is passed through the labeling system.

The exemplary processing unit may use (1) position data regarding the containers on pallets 1031, 1032, and 1033 (or otherwise grouped stacks of containers) that are present on the conveyor 1020 that are provided to it by position sensors (e.g., position sensors 1022*a*, 1022*b*, and 1022*c*) and/or encoders (e.g., encoders associated with conveyor motors 1021) and (2) position data regarding the applicator systems 1010*a* and 1010*b* provided to it by position sensors (e.g., position sensors and/or cameras within the applicator systems) and/or encoders (e.g., encoders associated with the horizontal track motors 1005*a* and 1005*b*, and elements of the applicator systems, including actuator arms and encoders associated with printer heads, etc.) to coordinate the movement of the pallets 1031, 1032, and 1033, the lift carriage 1070, the applicator carriages 1004*a* and 1004*b*, and the various components of the applicator systems 1010*a* and 1010*b*.

The exemplary labeling system 1000 may include a human interface device (e.g., a touchscreen; a combination of a keyboard, mouse, and a video monitor, etc.) for inputting information into the processing unit, such as selecting an appropriate pre-loaded reference data. The human interface device may allow a human operator to select pre-loaded reference data from a look-up table that can be viewed and accessed on a display. The human interface device may also allow for manually overriding the system to change various aspects of its operation.

FIG. 13*a* shows a snapshot of the operation of the exemplary labeling system 1000. In FIG. 13*a*, three pallets 1031, 1032, and 1033 each having a 2×4 regular arrangement of stacks of 10 containers thereon are present on conveyor 1020. Pallet 431 is shown to have already passed through the labeling station and labels are affixed to each of the eighty containers thereon. In the embodiment shown in FIG. 13*a*, there are position sensors 1022*a*, 1022*b*, and 1022*c* positioned at stopping points along the conveyor 1020. As a front edge of a pallet arrives at the position sensor 1022*b* within the labeling station, the sensor 1022*b* is tripped and sends a signal to the processing unit, which in response stops the conveyor motors to thereby hold the pallet 1031 in the labeling station and in proximity to the applicator systems 1010*a* and 1010*b*. The applicator systems 1010*a* and 1010*b* may then begin applying labels (or directly printing) onto each container in the leading row of containers on the pallet.

Figure 13B:
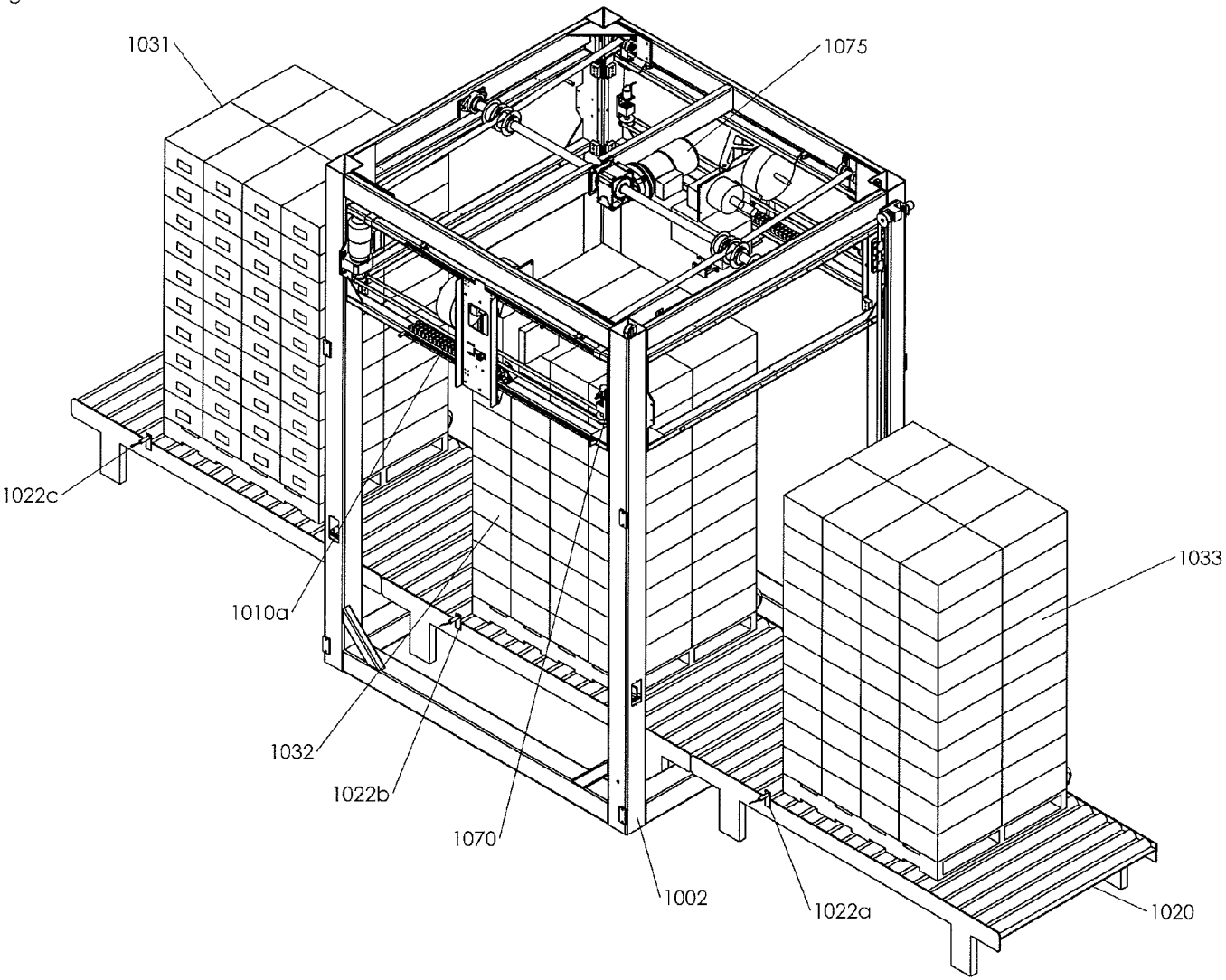
FIG. 13*b* is a perspective view of a label applicator system according an embodiment of the invention.

The exemplary lift carriage 1070 must be retracted away from the conveyor in order to allow a pallet to be admitted into the labeling station. FIG. 13*b* shows the lift carriage in the retracted position. The processing unit may direct the lift motor 1075 to retract the lift carriage 1070 to its highest position, once all the containers on a pallet have been labeled. The refraction of the lift carriage 1070 may allow the completed pallet (e.g., pallet 1031) to be conveyed out of the labeling station, and a new unlabeled pallet to be conveyed into the labeling station. Once the leading edge of the pallet trips the position sensor 1022*b*, the processing unit may direct the conveyor 1020 to stop and the lift carriage to be lowered into a start position. In some embodiments, the start position may be in alignment with the bottom containers on the pallet. The applicator carriage 1004 may also have a start position (e.g., aligned with a leading stack of containers on the pallet). As is suggested by the labeling pattern shown in 13*a*, the starting position may be at the lower most container in the leading container stack. However, the starting position may be at various positions, including at the top or bottom of a container stack, at the trailing container stack, etc.

Once the exemplary applicators systems 1010*a* and 1010*b* are in their starting positions, the processing unit can direct the movement and labeling and/or printing function of the applicator systems 1010*a* and 1010*b*. The processing unit controls the vertical movement of the lift carriage 1070, the horizontal movement of the applicator carriages 1004*a* and 1004*b*, and the movement of the various components of the applicator systems 1010*a* and 1010*b* based on the pre-loaded reference data that corresponds to the particular pallet to be labeled. Before the containers on a pallet are labeled, a pre-loaded reference data may be selected from an internal memory in the processing unit. The pre-loaded reference data may be selected by an operator of the system (e.g., without limitation, through the human interface). Based on pre-loaded reference data that corresponds to the particular arrangement of containers on the pallet, the processing unit may direct the motors within the applicator unit to print and apply a label to the container with which it is engaged (or directly print onto the container).

Once a label has been applied to a container, the exemplary processing unit directs the lift motor 1075 to move the lift carriage 1070 up a precise distance (e.g., equal to the height of one of the containers) based on the size data included in the pre-loaded reference data. As the carriage advances, the processing unit directs the applicator to apply a label at a set vertical position as instructed by the pre-loaded reference data. The processing unit advances the applicator systems 1010*a* and 1010*b* vertically (up or down) a set number of times based on the number of containers indicated in the grouping data included in the pre-loaded reference data. In some implementations (e.g., implementations in which the applicator is applying pre-printed labels), the applicator system can be advanced vertically through the stacked containers without stopping the carriage, the applicator arm is timed to apply a label and re-load a label "on the fly" as the carriage continues to move. In other implementations, the carriage may come to a brief stop (e.g., about 0.1 seconds to about 5 seconds, or any value or range of values therein, depending on the particular type of applicator, whether printing is required, and how much information is included on the label) at each container to allow the applicator some time to apply labeling and/or printing.

When the exemplary applicator systems 1010*a* and 1010*b* reach the last or top containers, the processing unit may direct the lift motor 1075 to return the lift carriage 1070 to its starting position at the bottom of the pallet, and the applicator systems 1010*a* and 1010*b* to the next stack. This process continues until the top containers in the last row of container stacks is labeled, at which point the lift carriage 1070 is raised and the pallet is conveyed out of the labeling station and down the conveyor 1020. In other embodiments, the processing system may instruct the lift motor 1075 to position the lift carriage 1070 at the top of the container stack to start the labeling process, rather than the bottom. In other embodiments, the applicator systems 1010*a* and 1010*b* may advance from stack to stack in a serpentine fashion, e.g., moving up through a first stack, then from the top container in the first stack to the top container in the second stack, and then down through the second stack, and so on.

In other implementations, labels may be applied in sequence along a bottom row of containers on the pallet (in a front-to-back/back-to-front (east-west) operation), rather than in sequence from a bottom container to a top container along a row (the top-to-bottom operation described above). The processing unit may direct the applicator systems 1010*a* and 1010*b* to move from container to container horizontally along the horizontal applicator tracks 1003*a* and 1003*b* to sequentially label containers in horizontal rows, instead of vertical columns. After a horizontal row is completed, the processing unit may direct the lift motor 1075 to lift the lift carriage 1070 to the next horizontal row and direct the applicator system to apply labels horizontally to that row.

The present invention encompasses other embodiments and implementations of a four-sided frame system. Such embodiments may include a lift carriage that allows the passage of pallets and otherwise grouped container stacks through the labeling station. More specifically, in some embodiments, and without limitation, the lift carriage may not have any components or elements that pass across or are located directly over the conveyor. In such embodiments, the lift carriage may include two applicator systems that may be located on opposite lateral sides of the conveyor. Because there are no components of the lift carriage over the conveyor to obstruct the passage of the pallets (or otherwise grouped container stacks), the pallets can pass through such a labeling station without the need to retract the lift carriage.

Figure 14:
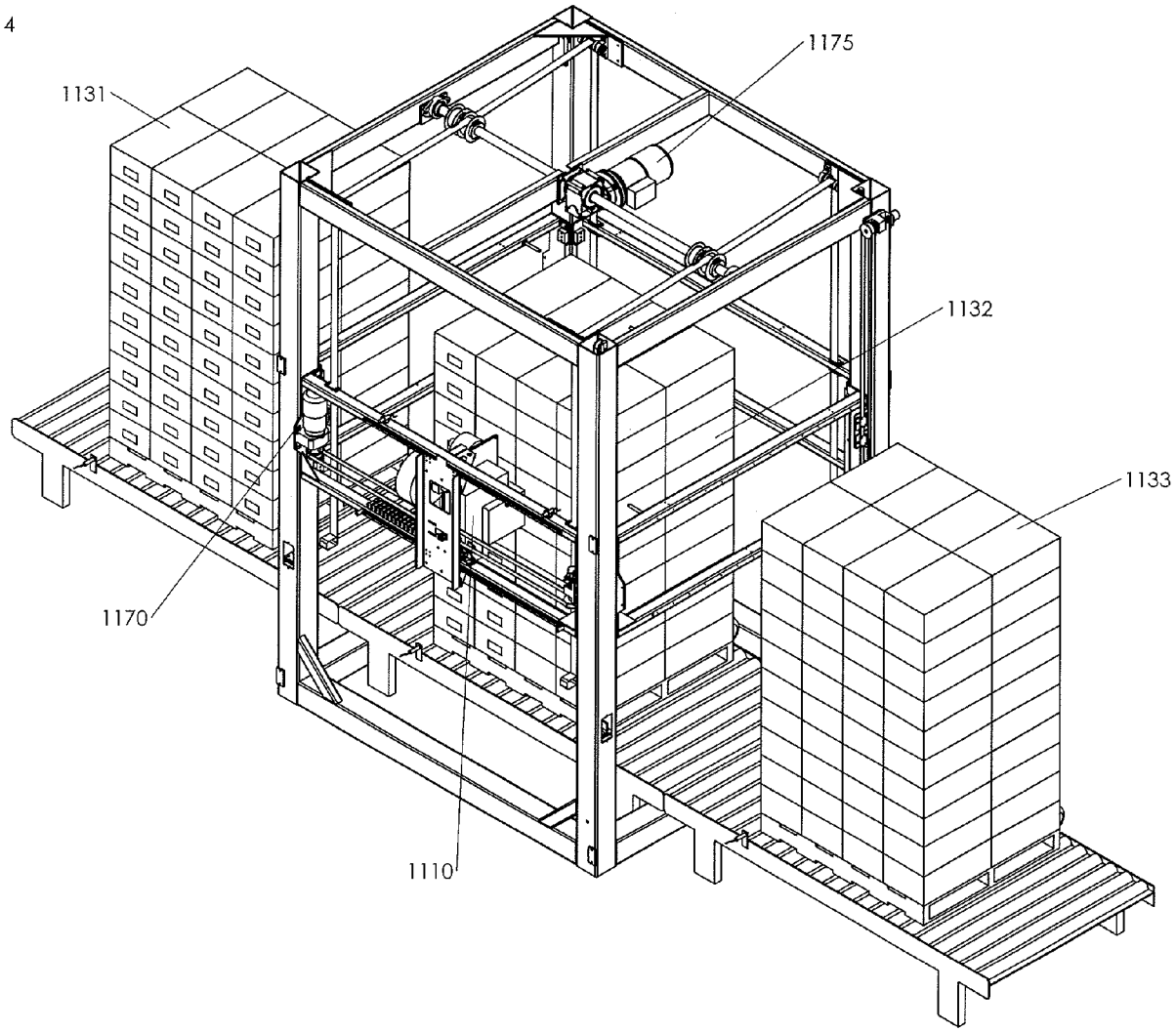
FIG. 14 is a perspective view of a label applicator system according an embodiment of the invention.
Figure 15:
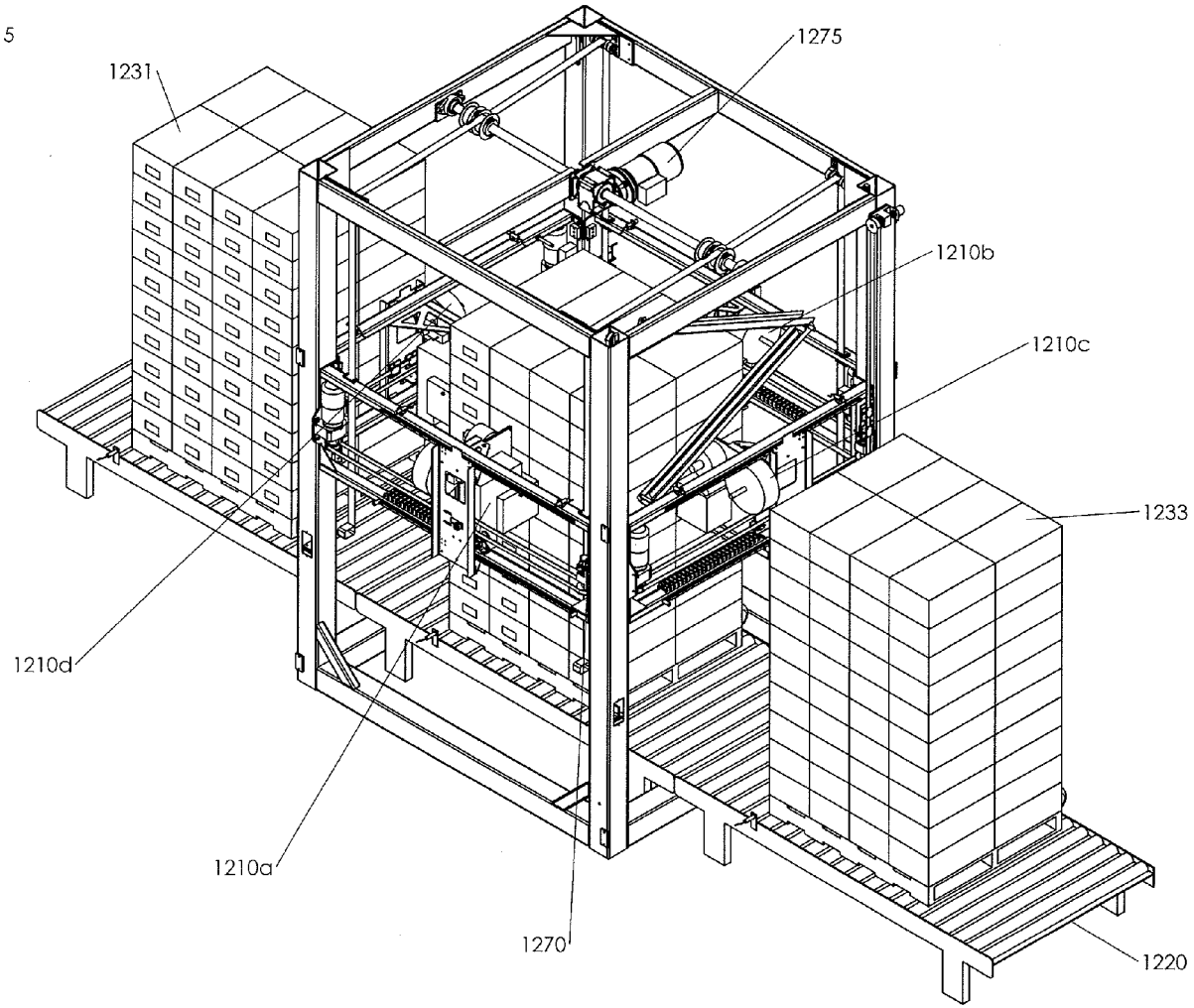
FIG. 15 is a perspective view of a label applicator system according an embodiment of the invention.

In further embodiments of a four-sided frame system, the labeling system may vary in the number of applicator systems mounted thereon. FIG. 14 shows an exemplary embodiment of a labeling system having a frame 1102, a lift carriage 1170, and a single applicator system 1110 mounted on the lift carriage 1170. FIG. 15 shows an further exemplary embodiment of a labeling system having a frame 1202, a lift carriage 1270, and four applicator systems 1210*a*, 1210*b*, 1210*c*, and 1210*d*, each mounted a different side of the lift carriage 1270. This embodiment may allow the labeling system to apply labels to containers on four sides of a pallet when needed (e.g., for irregular or nested arrangements of containers). The motors, sensors, processing units, and other elements and components of the embodiments shown in FIGS. 14-15 and other embodiments of the present invention may work in the same or similar way as the other embodiments described herein. It is to be appreciated that although FIG. 14 shows a single applicator system, and FIG. 15 shows a four applicator system, that other similar embodiments with two applicators or with three applicators may also be provided; and that the positions of the applicator(s) may be in any suitable position or combination of positions in 1-applicator, 2-applicator and 3-applicator systems.

Although containers are ordinarily stacked in uniform columns for shipment and storage, there are situations where this is not necessarily the case. Sometimes containers may be irregularly stacked or stacked in nested patterns that do not include uniform columns, as illustrated in FIGS. 2 and 3, and as discussed above. It is to be appreciated that embodiments of the invention are capable of automatically labeling such irregularly placed containers. For example and without limitation, if the containers on a given pallet are stacked in an offset manner, such that containers on alternating tiers are uniformly offset from each other (akin to bricks on a wall), then the methods, systems and apparatus of the present invention are capable of providing labels on these containers. For example, and without limitation, when the leading edge of such containers on a pallet reaches the first sensor (e.g. 122*a*) and the pallet conveyor 120 is stopped, the applicator system 110 may travel in a vertical direction, but only applying labels to every other container. Once this is accomplished, instead of advancing the distance of a full container, the conveyor only advances half of this distance (which may be accomplished by appropriately setting/changing the position of sensor 122*b*) before stopping again. At this point, the applicator system 110 again travels in a vertical direction, this time applying labels to every other intervening container. Once the second set of labeling is accomplished, again instead of advancing the distance of a full container, the conveyor only advances half of this distance (according to the position of sensor 122*c*) before stopping, at which point the applicator system 110 again applies labels to every other container, and so on.

Although the above example refers to the embodiments of FIG. 4 (and FIG. 7), it is to be appreciated that other embodiments of the present invention, for example and without limitation those shown in FIGS. 5 and 6, are also capable of providing labeling on non-uniformly stacked containers, for example, by adjusting the horizontal and vertical positioning of the applicator systems according to the expected positions of the containers. In those situations where the positions of the containers are not uniform, or not in an expected arrangement, an operator may input the positions into the system, which has programming to efficiently move the conveyors and/or applicator systems in order to label each such container.

It is to be understood that variations and modifications of the present invention may be made without departing from the scope thereof. It is to be appreciated that the features disclosed herein may be used different combinations and permutations with each other, all falling within the scope of the present invention. It is also to be understood that the present invention is not to be limited by the specific embodiments disclosed herein, but only in accordance with the appended claims when read in light of the foregoing specification.

What is claimed is:

1. A system for applying labels or printed information to individual containers in a stack, comprising:

a. a first applicator system having:
   i. a first vertical member having a first vertical track thereon,
   ii. a first carriage connected to said first vertical track, and
   iii. a first applicator mounted on said first carriage;

b. a second applicator system having:
   i. a second member having a second vertical track thereon,
   ii. a second carriage connected to said second vertical track, and
   iii. a second applicator mounted on said second carriage;

c. at least one motion imparting member for moving said first carriage along said first vertical track and said second carriage along said second vertical track;

d. a conveyor located between said first applicator system and said second applicator system, wherein said conveyor is configured to sequentially position adjacent stacks of containers between said first and second applicator systems, and said first and second applicators are operable to move vertically along said first and second tracks and apply labels or print onto multiple individual containers of each of said stacks; and e. a processing unit in electronic communication with said conveyor, said first carriage, said second carriage, said first applicator, and said second applicator, and configured to control the positions of said conveyor, said first carriage, and said second carriage, and to operate said first and second applicators.

2. The system of claim 1, wherein said system includes a sensor for identifying a position of said stacked containers, said sensor being in electronic communication with said processing unit and configured to send data to said processing unit regarding said position of said stacked containers.

3. The system of claim 1, wherein said first applicator comprises a first actuator for horizontally extending a first applicator arm toward said stacked containers, and said second applicator comprises a second actuator for horizontally extending a second applicator arm toward said stacked containers.

4. The system of claim 3, wherein each of said first and second actuator arms includes a buffer system for accommodating variable distances between said stacked containers and said first and second applicators.

5. The system of claim 1, wherein said adjacent stacks of containers are packaged on a pallet in a three-dimensional pattern that is at least two containers wide and at least two containers long.

6. The system of claim 1, wherein said at least one motion imparting member comprises a motor coupled with a drive element, wherein said drive element is connected to said first carriage and said second carriage.

7. The system of claim 6, wherein said processing unit controls the movement and position of said first and second carriages with computer numerical control.

8. The system of claim 1, wherein said conveyor is motorized, and said processing unit controls the movement and position of said conveyor with computer numerical control.

9. The system of claim 1, wherein each of said first and second applicators comprises:

a. a label feed, and b. a label applicator mounted on an actuator for horizontally extending toward said stacked containers, wherein said label feed supplies labels to said label applicator and said label applicator applies a label onto each of said stacked containers.

10. The system of claim 9, wherein each of said first and second applicators further comprises a printer for printing identifying information on labels.

11. The system of claim 10, wherein said printer is configured to print information on each label that is specific to a particular container.

12. The system of claim 1, wherein said first and second vertical tracks are aligned on a vertical plane that is perpendicular to said conveyor.

13. The system of claim 1, wherein said first and second applicators are configured to apply labels or printing to separate containers of said adjacent stacks of containers simultaneously.

14. The system of claim 13, wherein said stacked containers are positioned on a pallet.

15. The system of claim 1, wherein said system further comprises a rack on which said first and second applicator systems are mounted, and said rack can be retracted vertically to allow stacked containers on said conveyor to pass below said rack.

16. A system for applying labels or printed information to individual containers in a stack, comprising:

a. at least one applicator system having:
   i. a horizontal track,
   ii. a carriage movably mounted on said horizontal track, wherein said carriage is connected to a mechanism for moving said carriage along said horizontal track,
   iii. an extension system on said carriage for extending out from said carriage and retracting back toward said carriage, and
   iv. an applicator mounted on said extension system;
b. a vertical track on which said at least one applicator system is mounted;
c. a vertical actuator for moving said at least one applicator system along said vertical track;
d. a conveyor located adjacent to said track for positioning multiple, adjacent stacks of containers into a position in which said containers are accessible to said applicator, and said at least one applicator system is operable to move along said horizontal track and said vertical track to position said applicator in proximity to multiple individual containers within each of said stacks of containers and apply labels or printing to said multiple individual containers within each of said stacks of containers; and
e. an electronic system for controlling the position of said conveyor, said carriage, and said extension system, and for operating said applicator.

17. The labeling system of claim 16, further comprising a frame located over said conveyor, wherein said applicator system is mounted on said frame.

18. The labeling system of claim 16, further comprising a second applicator system, said second applicator system including i. a second horizontal track,
ii. a second carriage movably mounted on said second track, wherein said carriage is connected to a mechanism for moving said carriage along said second track,
iii. a second extension system on said second carriage for extending out from said second carriage and retracting back toward said second carriage;
iv. a second applicator mounted on said second extension system.

19. The labeling system of claim 18, further comprising a frame located over said conveyor, wherein said applicator systems are mounted on said frame, and said frame is operable to move along said vertical track.

20. The labeling system of claim 19, wherein said first and second applicator systems are mounted on opposite lateral sides of said conveyor.

21. The labeling system of claim 18, wherein one of said carriages includes a sensor for identifying a position of said stacked containers, said sensor being in electronic communication with said computer system and configured to send data to said computing system regarding said position of said stacked containers.

22. A method of labeling stacked containers, comprising:

a. placing at least two stacks of containers on a conveyor, wherein said at least two stacks of containers are adjacent and are arranged sequentially along the length of said conveyor;
b. moving said at least two stacks of containers into a static position at a labeling station, wherein said labeling station comprises a first applicator system and a second applicator system, said first applicator system and said second applicator system being on opposite sides of said conveyor;
c. applying identification information to multiple individual containers in each of said at least two stacks of containers, wherein said first applicator system applies said identification information to multiple individual containers in said first and second stacks of containers while said first and second stacks of containers are in said static position in said labeling station.

23. The method of claim 22, wherein said at least two stacks of containers are grouped together such that adjacent stacks of containers contact each other.

24. The method of claim 23, wherein said first stack of containers is within a first lateral row of containers and said second stack of containers is within a second lateral row of containers.

25. The method of claim 24, wherein said conveyor advances said at least two stacks of containers in a stepwise manner, such that each of the lateral rows of stacked containers are sequentially parked between said first and second applicators to allow said first and second applicators to apply said identification information to each of the containers in each lateral row of stacked containers.

26. The method of claim 24, wherein moving said at least two stacks of containers to a labeling station comprises:

a. parking said first lateral row of stacked containers between said first and second applicator systems for a sufficient time to allow said first and second applicators to apply said identification information to said multiple individual containers in said first lateral row of containers, and
b. subsequently parking said second lateral row of stacked containers between said first and second applicator systems for a sufficient time to apply said identification information to multiple individual containers in said second lateral row of containers.

27. The method of claim 22, wherein said labeling station further comprises a rack on which said first and second applicator systems are mounted.

28. The method of claim 27, wherein said labeling station can be retracted vertically to allow stacked containers on said conveyor to pass below said rack.

29. The method of claim 22, further comprising detecting a leading edge of said first lateral row of containers, wherein said first applicator system has a sensor for detecting said leading edge of said first lateral row of containers.

30. The method of claim 29, wherein said sensor transmits data regarding a location of said first lateral row of containers to a computing system with which said sensor is in electronic communication.

31. The method of claim 30, wherein one or more additional stacks of containers are arranged in one or more additional lateral rows along the length of said conveyor in a predetermined pattern of lateral rows.

32. The method of claim 31, wherein said computing system has a reference pattern that corresponds to said predetermined pattern of lateral rows in an internal memory of said computing system.

33. The method of claim 32, wherein said reference pattern includes the size of the individual containers, the location of each individual container in said predetermined pattern, and one or more predetermined locations on each of the individual containers at which said identifying information is to be applied.

34. The method of claim 33, wherein said reference pattern includes identifying information that is unique to each of said individual containers, wherein applying said identifying information includes applying said unique identifying information to the corresponding individual container.

35. The system of claim 22, wherein said system further comprises a rack on which said at least one applicator systems is mounted, and said rack can be retracted vertically to allow stacked containers on said conveyor to pass below said rack.

36. The method of claim 22, wherein said at least two stacks of containers comprises a third stack of containers arranged side-by-side with said first stack of containers in a first lateral row across the width of said conveyor, and said second applicator system applies said identification information to multiple individual each of the containers in said second stack of containers.

37. An apparatus for marking items comprising:

a. A vertically oriented support member having a track along said member;

b. A support carriage movably engaged with said track and attached to a vertical motion imparting member operable to move said carriage vertically along said track;

c. A movable support member on said carriage that may be extended and retracted in a horizontal direction;

d. An applicator unit located on said support member of said carriage;

e. A conveyor located adjacent to said vertically oriented support member, said conveyor being capable of moving at least one stack of items located thereon into a marking position accessible to said applicator;

f. At least one sensor adjacent to said conveyor for determining a position of said at least one stack of items on said conveyor; and g. An electronic control unit in communication with said conveyor, said at least one sensor, said vertical motion imparting member, said movable support member, and said applicator unit, wherein said electronic control unit is operable to control said vertical motion imparting member to position said applicator unit in alignment with multiple individual items in said at least one stack of items and to control said moveable support member to extend said applicator unit and mark said individual items in said at least one stack.

38. The apparatus of claim 37 further comprising programming in said control unit for operating said conveyor, for identifying when at least one stack of items reaches a position relative to said at least one sensor, for operating said vertical motion imparting member to move said carriage into alignment with said multiple individual items in said at least one stack of items, for extending and retracting said movable support member, and for causing said applicator unit to mark said at least one item.

39. The apparatus of claim 38 wherein a plurality of sensors are provided adjacent to said conveyor, and wherein said electronic control includes programming for starting and stopping said conveyor according to information received from said plurality of sensors indicating the positions of said plurality of items.

40. The apparatus of claim 39 further comprising a database of item size, item count and item position information provided in said control unit.

41. The apparatus of claim 40 further comprising programming in said control unit for operating said vertical motion imparting member, said movable support member, said applicator unit and said applicator to mark individual items according to information contained in said database.

42. The apparatus of claim 37 wherein said vertical motion imparting member is selected from the group of: a chain, a belt, a perforated track, a cord, a cable and combinations thereof.

43. The apparatus of claim 37, wherein said apparatus further comprises a rack to which said support carriage is attached, and said rack can be retracted vertically to allow stacked containers on said conveyor to pass below said rack.

44. A process of marking containers comprising the steps of:

a. Moving at least one stack of containers such that a first group of said containers is located adjacent to a movable marking apparatus;

b. Moving a carriage having an extendable member thereon in a vertical direction adjacent to said group of containers until an endmost container of said group is detected, said extendable member supporting a marking apparatus;

c. extending said extendable member toward said group of containers, marking a first container of said group using said marking apparatus, and retracting said extendable member away from said group of containers;

d. moving said carriage a pre-determined distance to position in which said extendable member in alignment with a second container of said group; and e. extending said extendable member toward said second container, marking said second container using said marking apparatus, and retracting said extendable member way from said group of containers.

45. The process of claim 44 comprising the additional steps of repeating the steps of claim 44 until an opposite endmost container of said group of containers is detected.

46. The process of claim 45 comprising the additional steps of:

a. advancing said stack forward relative to said marking apparatus such that a second group of containers is located adjacent to said movable marking apparatus;

b. Moving said carriage in a vertical direction adjacent to said second group of containers until an endmost container of said group is detected; and c. Moving said extendable member away from said carriage toward said second group of containers, marking a container using said marking apparatus, and retracting said extendable member away from said container.

47. The process of claim 46 comprising the additional steps of:

a. Moving said carriage in a vertical direction until said carriage is positioned adjacent to another container of said second group;

b. Moving said extendable member away from said carriage toward said another container of said second group, marking said another container using said marking apparatus, and retracting said extendable member away from said container.

48. The process of claim 47 comprising the additional steps of repeating the steps of claim 47 until an opposite endmost container of said second group of containers is detected.

* * * * *